US012527416B2

(12) United States Patent
Alverson et al.

(10) Patent No.: US 12,527,416 B2
(45) Date of Patent: Jan. 20, 2026

(54) INFANT STABILIZER

(71) Applicant: SmolTap, Inc., Providence, RI (US)

(72) Inventors: Brian Alverson, Barrington, RI (US); Ravi Stephen D'Cruz, Seattle, WA (US); Daniel Joseph Nelsen, Bristol, RI (US)

(73) Assignee: SmöTap, Inc., Providence, RI (US)

( * ) Notice: Subject to any disclaimer, the term of this patent is extended or adjusted under 35 U.S.C. 154(b) by 317 days.

(21) Appl. No.: 18/181,862

(22) Filed: Mar. 10, 2023

(65) Prior Publication Data

US 2023/0200560 A1 Jun. 29, 2023

Related U.S. Application Data

(63) Continuation-in-part of application No. 17/070,024, filed on Oct. 14, 2020, now Pat. No. 11,628,113.

(60) Provisional application No. 63/332,368, filed on Apr. 19, 2022, provisional application No. 62/915,305, filed on Oct. 15, 2019.

(51) Int. Cl.
*A47D 13/08* (2006.01)
*A47D 15/00* (2006.01)

(52) U.S. Cl.
CPC ..... *A47D 13/08* (2013.01); *A47D 15/006* (2013.01)

(58) Field of Classification Search
None
See application file for complete search history.

(56) References Cited

U.S. PATENT DOCUMENTS

| | | | | |
|---|---|---|---|---|
| 4,207,879 | A | 6/1980 | Safadago et al. | |
| 4,291,917 | A | 9/1981 | Hawks | |
| 6,273,865 | B1 * | 8/2001 | Perez | A61H 11/00 601/49 |
| 9,056,041 | B2 | 6/2015 | Cho et al. | |
| 2005/0028286 | A1 * | 2/2005 | Smart | A61F 5/3784 5/655 |
| 2007/0209116 | A1 | 9/2007 | Simon | |

(Continued)

OTHER PUBLICATIONS

Pretlow, III, Robert A, "The LP Seat: A Device for Positioning and Restraining Infants and Children for Lumbar Puncture," Pediatrics, Official Journal of the American Academy of Pediatrics, 1977, https://pediatrics.aapublications.org/content/59/1/128, Accessed Sep. 15, 2020.

(Continued)

*Primary Examiner* — Adam C Ortiz
(74) *Attorney, Agent, or Firm* — Hinckley, Allen & Snyder, LLP; David R. Josephs

(57) ABSTRACT

The invention relates to an infant positioning device for stabilizing and maintaining an infant in a fixed position for a lumbar puncture procedure. The device consists of a frame stand with openings for the infant's face and abdomen to support the infant in the proper position for the procedure and allow for unimpeded ventilation, a component of the frame to secure and stabilize the infant within the frame stand to prevent movement during the procedure, and an attachment stand to the frame that allows the frame to be free-standing. Vertically adjustable shoulder guards, tension-adjustable back strap, and tension adjustable head strap are provided for a custom fit.

19 Claims, 18 Drawing Sheets

(56) References Cited

U.S. PATENT DOCUMENTS

| | | | | |
|---|---|---|---|---|
| 2008/0271248 | A1* | 11/2008 | DeLaura | A61G 13/0054 5/638 |
| 2011/0056025 | A1* | 3/2011 | Jew | A47C 27/15 5/724 |
| 2015/0075539 | A1 | 3/2015 | Serdyuk | |
| 2019/0269258 | A1 | 9/2019 | Descamps et al. | |
| 2019/0290470 | A1* | 9/2019 | Chen | A61G 13/1215 |
| 2019/0350804 | A1 | 11/2019 | Jagger | |
| 2021/0106482 | A1 | 4/2021 | Alverson et al. | |

OTHER PUBLICATIONS

Boettner, Angela, University of Nebraska, "The Effectiveness of a Pediatric Lumbar Puncture Restraint Device (SNOWBOARD)," ClinicalTrials.gov, U.S. National Library of Medicine, URL: https://clinicaltrials.gov/ct2/show/study/NCT00980070?cond=positioning+device&draw=2&rank=5, Accessed Sep. 15, 2020.

Snow, Marcus MD, Infant Positioning, "Table Allows Doctors to Perform Complex Procedures with More Confidence,", UNEMED—Tech transfer for Nebraska, URL: https://unemed.com/product/infant-positioning#prettyPhoto, Accessed Sep. 15, 2020.

Williams, Michael A. MD, Spinal catheter insertion via seated lumbar puncture using a massage chair, American Academy of Neurology, p. 1859-1860 (Year: 2002).

* cited by examiner

INFANT STABILIZER

CROSS REFERENCE TO RELATED APPLICATION

This application is related to, and claims benefit from U.S. Provisional Patent Application No. 63/332,368 filed Apr. 19, 2022 entitled "INFANT STABILIZER,", and is a continuation-in-part of earlier filed U.S. patent application Ser. No. 17/070,024 filed Oct. 14, 2020 entitled "INFANT STABILIZER", which claims the benefit of U.S. Provisional Patent Application No. 62/915,305 filed Oct. 15, 2019 and entitled "INFANT STABILIZER," each of the foregoing incorporated herein in their entirety.

BACKGROUND OF THE INVENTION

For any febrile infant under 60 days of age, it is standard of care to perform a lumbar puncture (also known as a spinal tap) to sample cerebrospinal fluid (CSF) in certain cases including suspected cases of meningitis or depending on the age of the infant, even a fever. The success of this procedure is highly dependent on the individual holding the baby, rather than the one performing the procedure. As febrile infants can often move unexpectedly, such movements can cause the lumbar puncture to be unsuccessful, through no fault of the individual holding the baby or the one performing the procedure. These unexpected infant movements can lead to common problems, such as blood contamination of CSF specimens and the inability to obtain CSF, both of which interfere with the detection and diagnosis of meningitis, a potentially fatal infection that affects approximately 0.4% of febrile infants under 60 days of age.

It is known that delaying the administration of antibiotics is tightly associated with brain damage and death in infants with meningitis. As a result, a provider may administer antibiotics in the case of an ill-appearing infant even if a CSF sample is unable to be obtained. However, this poses an issue because premature antibiotic administration renders any subsequent CSF samples sterile, rendering the care team unable to select the most appropriate antibiotics. Additionally, in an infant who does not have meningitis, a blood-contaminated CSF sample may be uninterpretable, resulting in the unnecessary administration of 2-3 weeks of intravenous antibiotics in the inpatient setting. Therefore, because of the inability to obtain an adequate CSF sample, infants commonly receive unnecessary antibiotics and have a prolonged hospitalization, at great cost to the medical system. Currently, a successful spinal tap is generally considered to be "hold dependent," and thus, approximately 25% of infant taps are unsuccessful or contaminated with blood.

Prior art solutions are varied and fail to provide for the safety of the infant in reliable manner. They often involve a number of discrete pieces which must be secured to a fixed table. For example, one such device includes at least three discrete pieces which attempts to secure the infant in a lateral recumbent position. The child is placed on a cloth covered board and the securement pieces are fixed using a hook and loop fastener. If the child is scared and in pain, they are likely able to exceed the needed forces to dislodge the discrete pieces that are there to secure them which can result in injury to the child or invalid results. Such prior art devices, and other alternatives, are cumbersome and can create undue stress for the infant.

As such, there is a need in the art for a device that allows for standardized and effective performance of lumbar puncture procedures.

SUMMARY OF THE INVENTION

The present invention preserves the advantages of prior art infant stabilizers while additionally providing new advantages not found in currently available infant stabilizers and overcomes many disadvantages of such currently available infant stabilizers.

The present invention provides an infant stabilizer device that can better stabilize an infant and that does not suffer from the disadvantages in the prior art. The present invention provides an infant stabilizer that can better secure an infant in the proper "crunch" position to better prevent movement during a procedure. Moreover, the present invention enables a free-standing stabilizer that allows for unimpeded ventilation to allow the infant to breathe freely. Additionally, or alternatively, the present disclosure provides for an adjustable stabilizer that can be sized for infants of various sizes.

Advantageously, the instant devices can improve the rates of non-traumatic lumber punctures and maintain the infant's ability to breathe comfortably—while maintaining the infant in a secure upright position which has been shown to be better positioning for maximal width of spinal fluid column. These advantages during the procedure can lead to lower costs and shorter hospital stays.

BRIEF DESCRIPTION OF THE DRAWING FIGURES

The novel features which are characteristic of the present invention are set forth in the appended claims. However, the invention's preferred embodiments, together with further objects and attendant advantages, will be best understood by reference to the following detailed description taken in connection with the accompanying drawings in which:

Figure 12A:
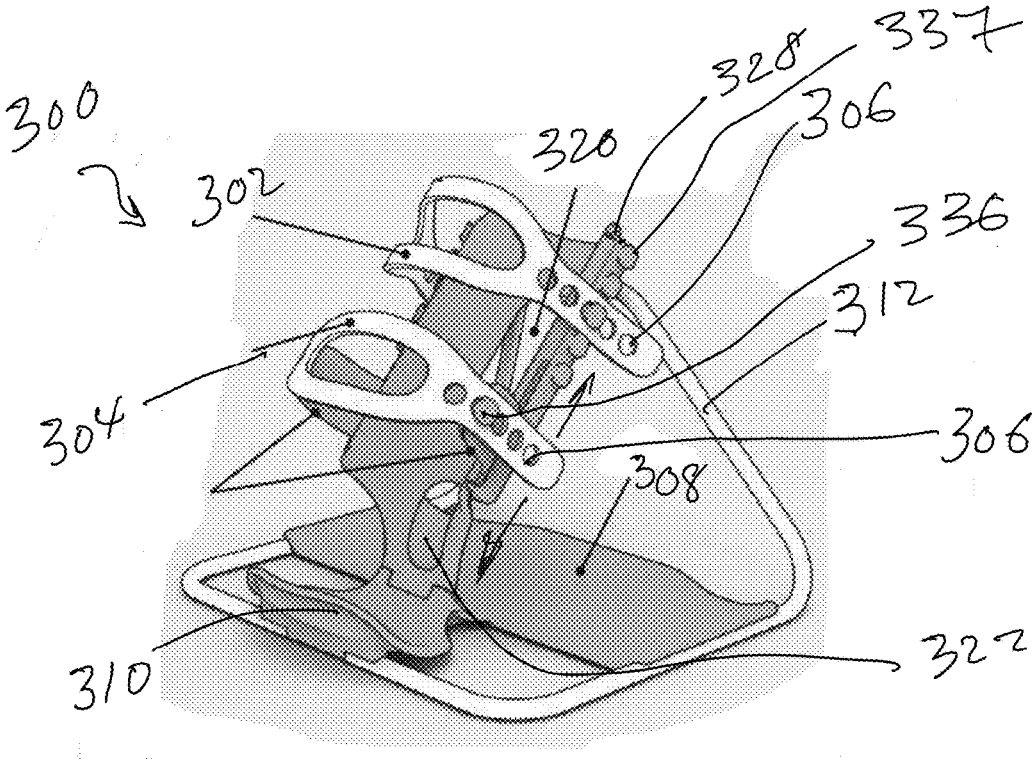
Figure 12B:
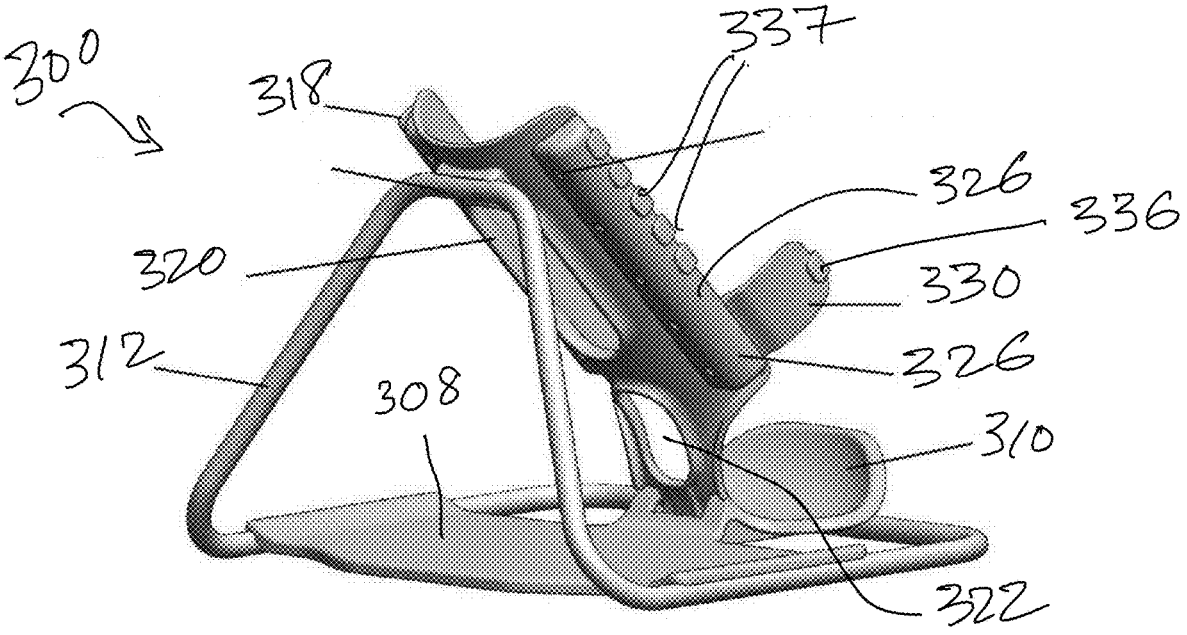
Figure 12C:
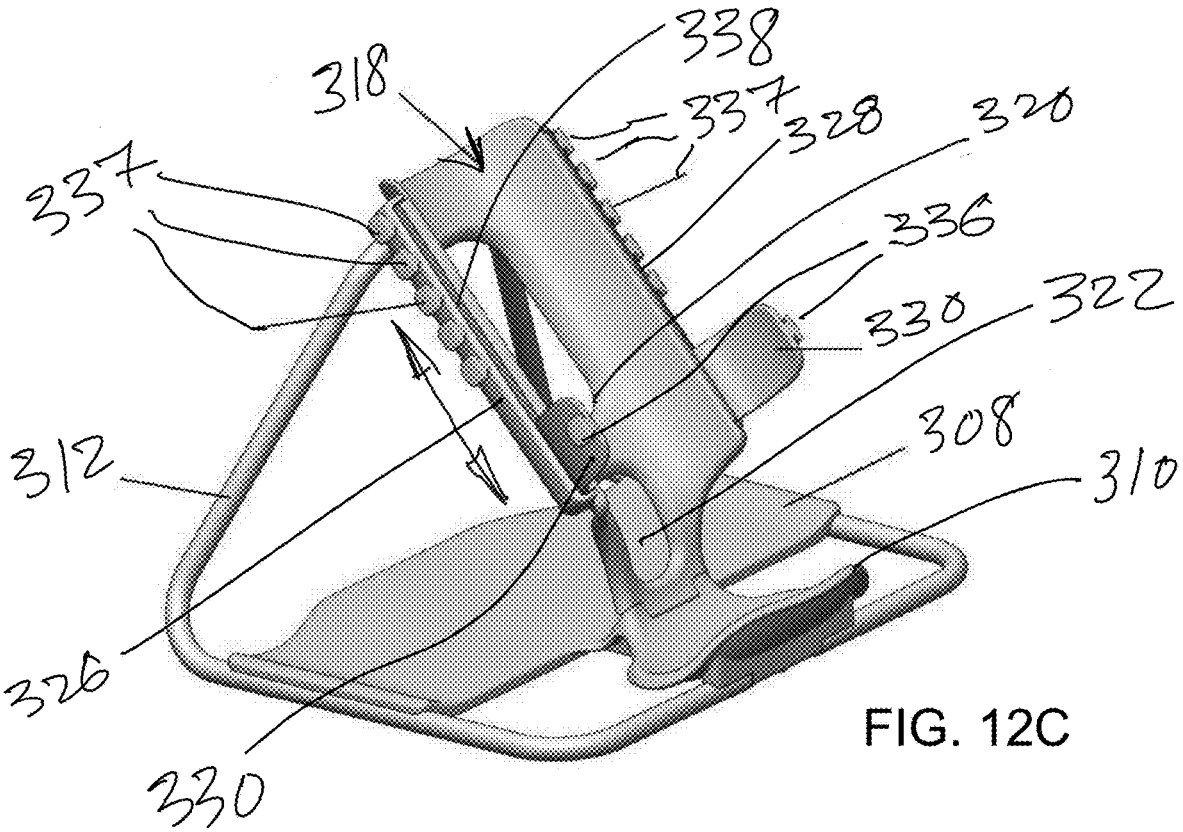
Figure 12D:
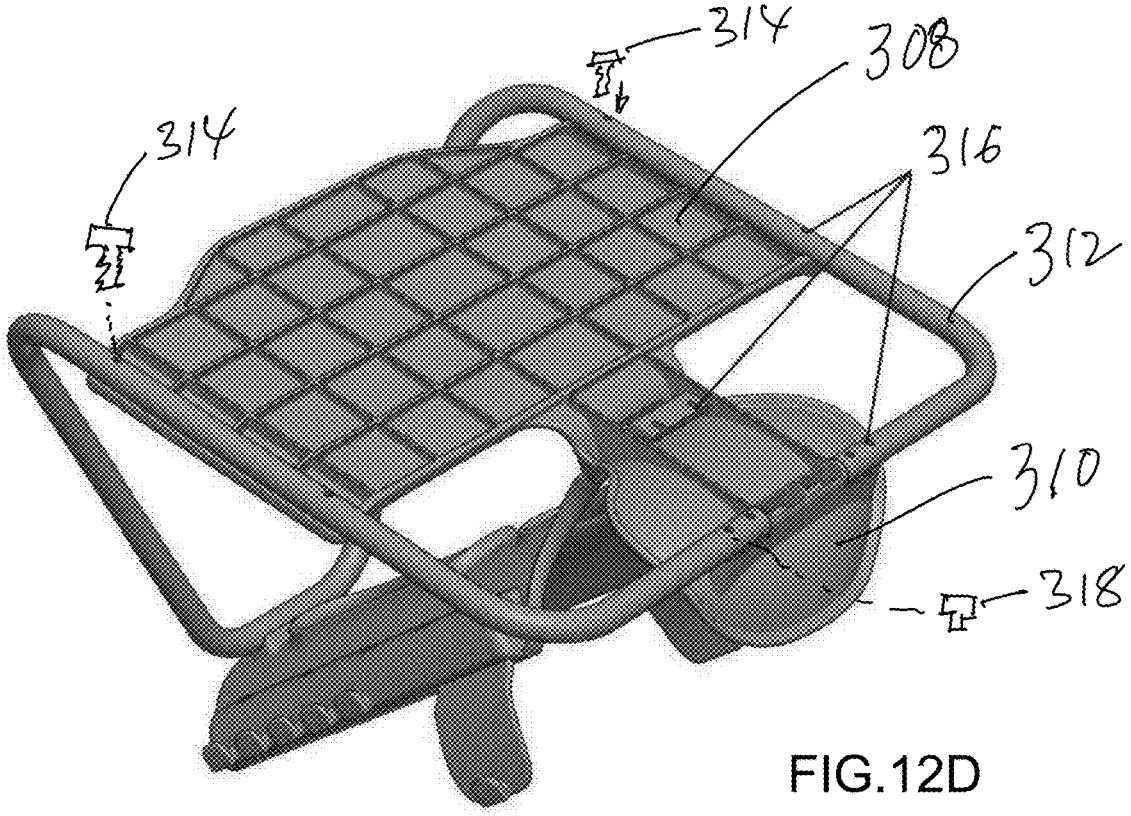
Figure 13A:
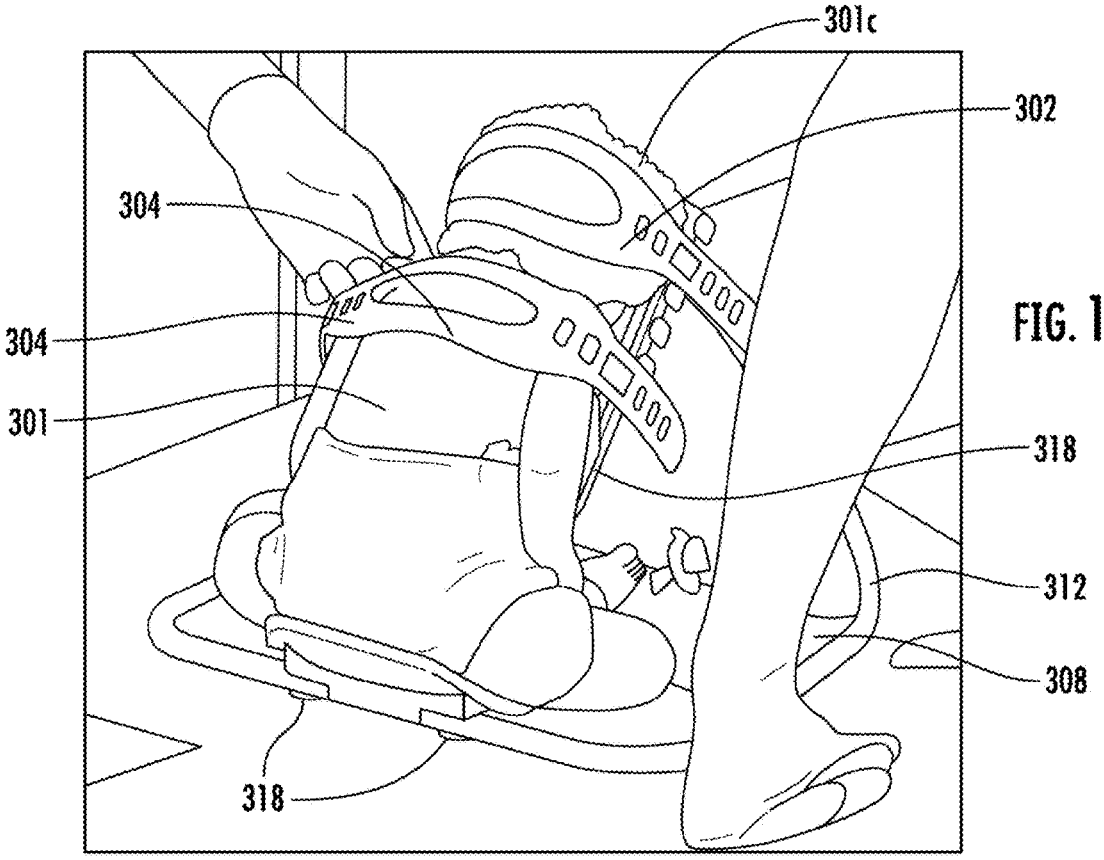
Figure 13B:
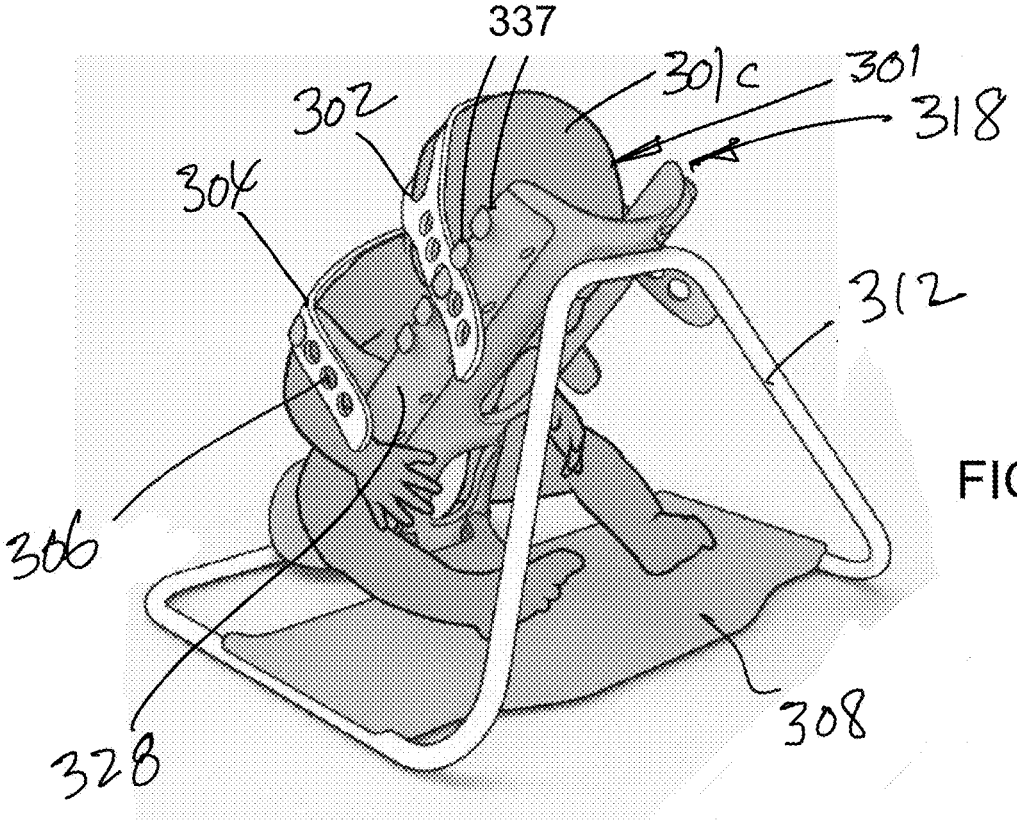
Figure 14A:
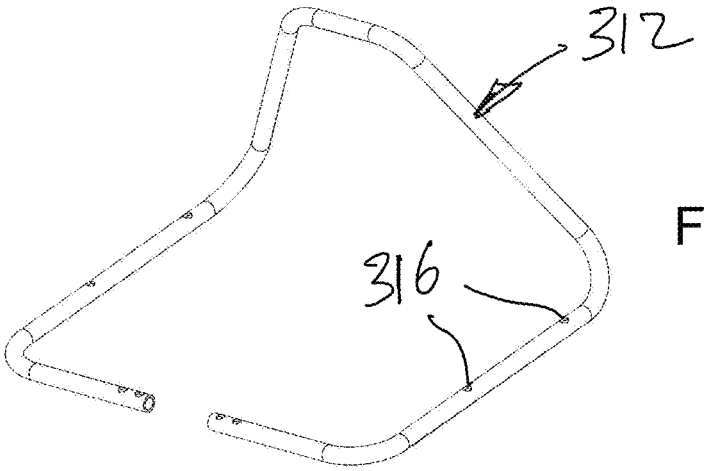
Figure 14B:
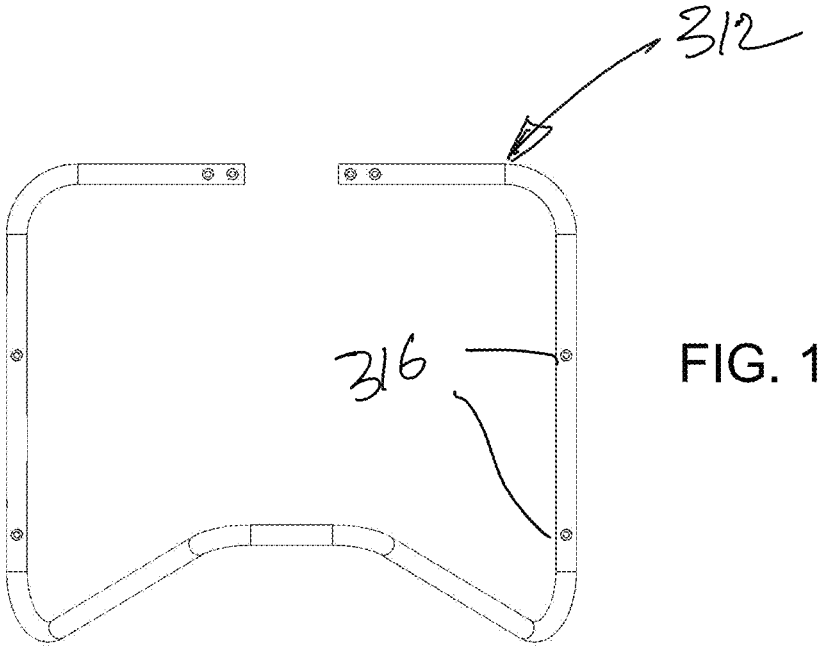
Figure 14C:
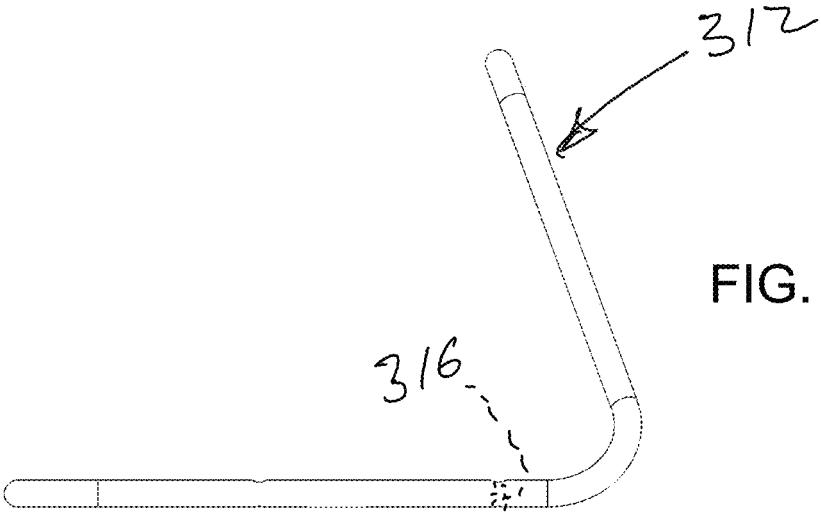
Figure 15A:
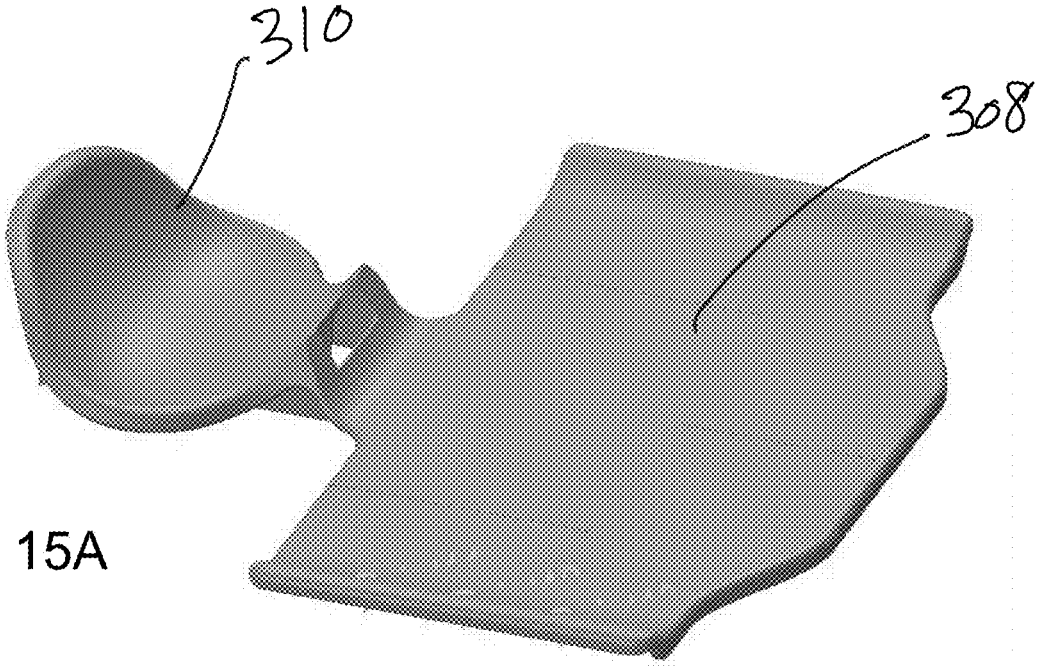
Figure 15B:
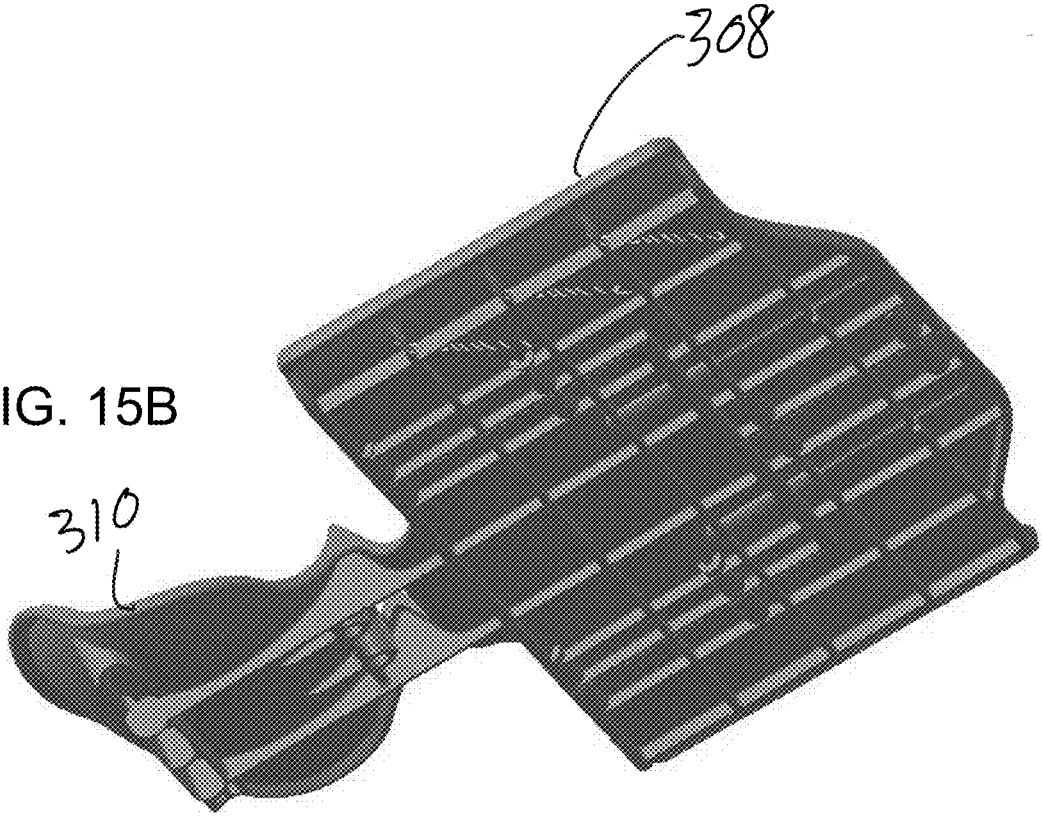
Figure 16A:
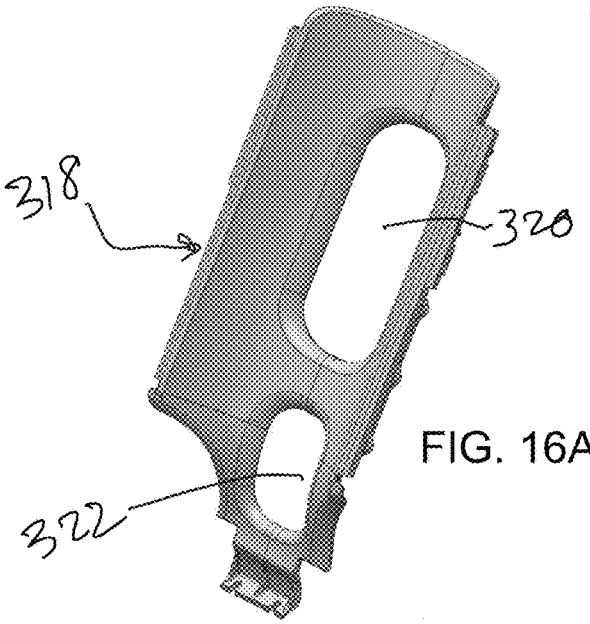
Figure 16B:
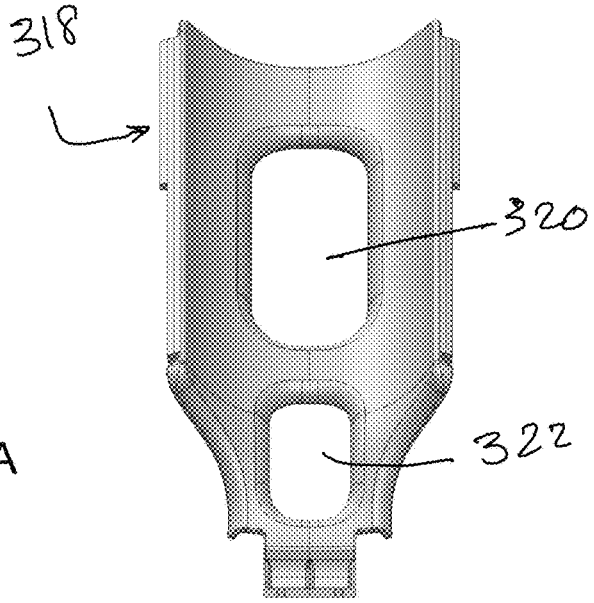
Figure 16C:
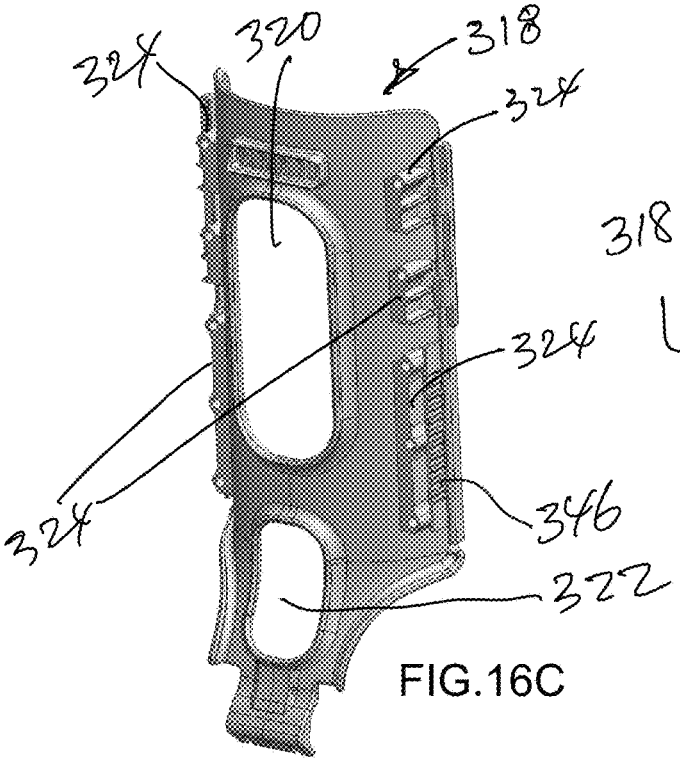
Figure 16D:
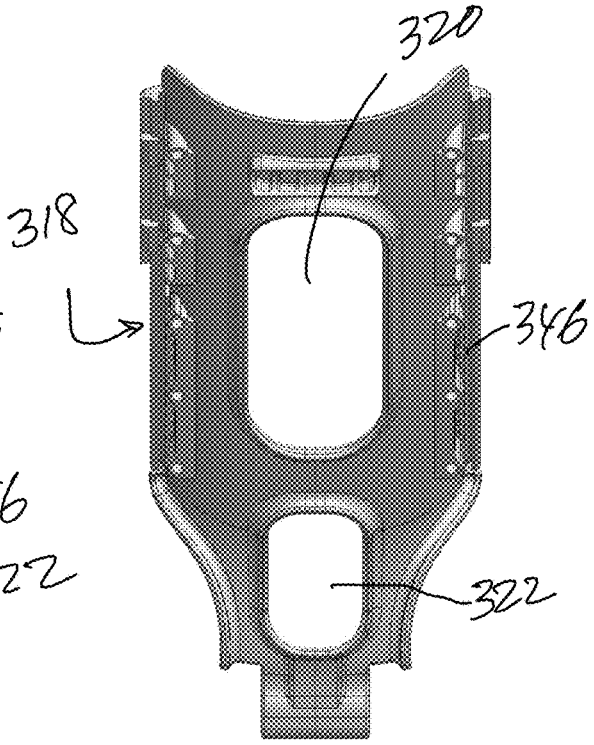
Figure 17A:
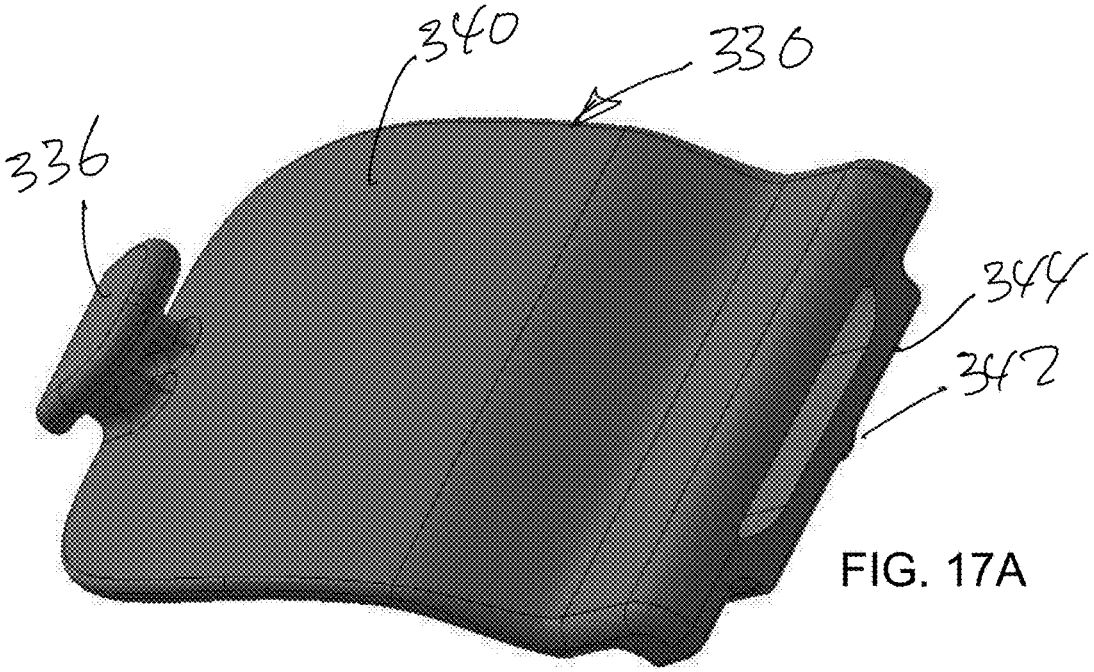
Figure 17B:
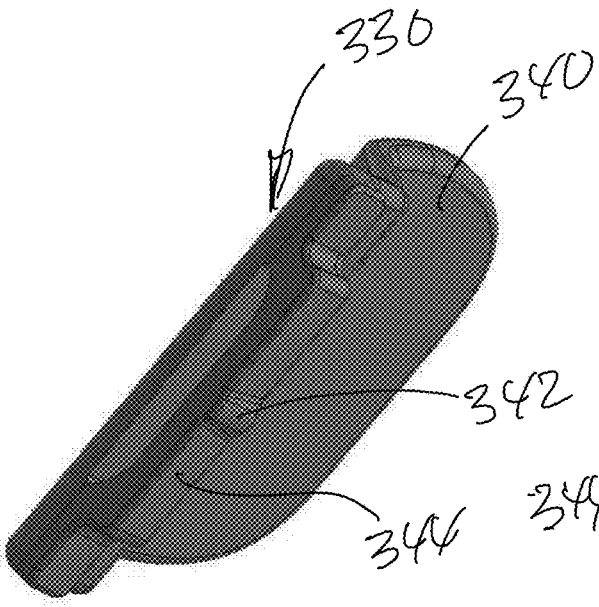
Figure 17C:
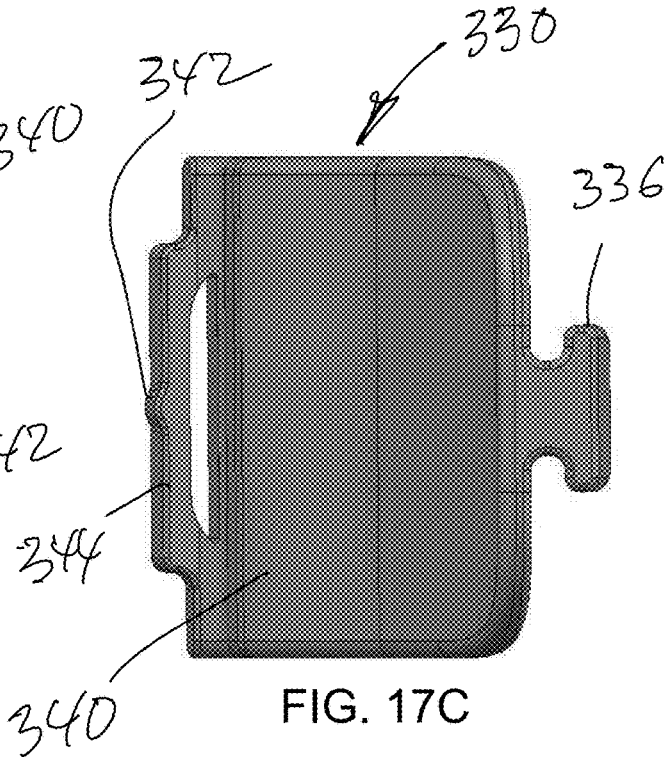
Figure 18A:
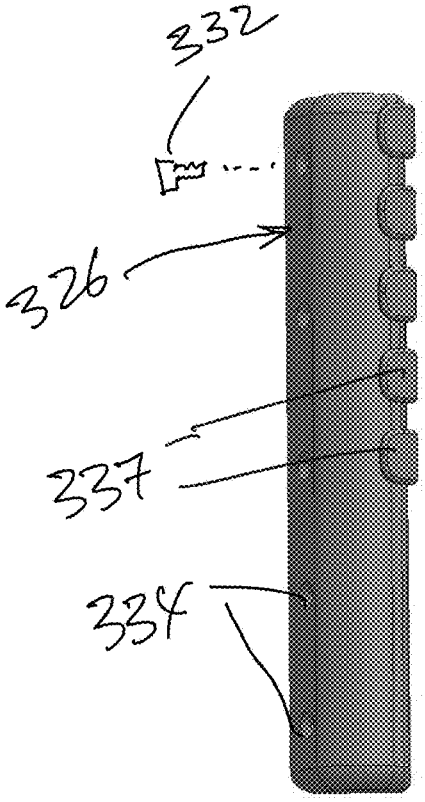
Figure 18B:
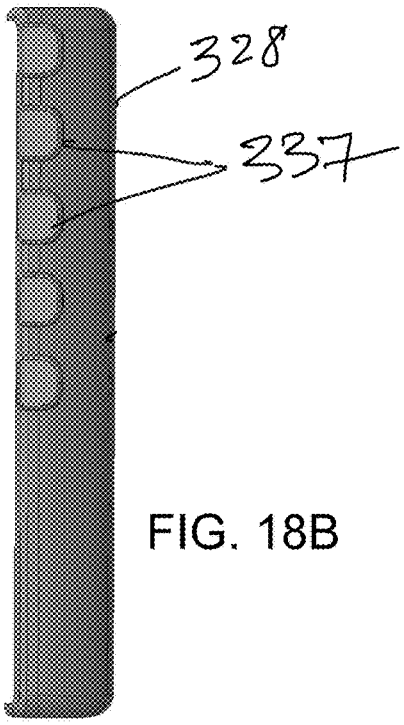
Figure 18C:
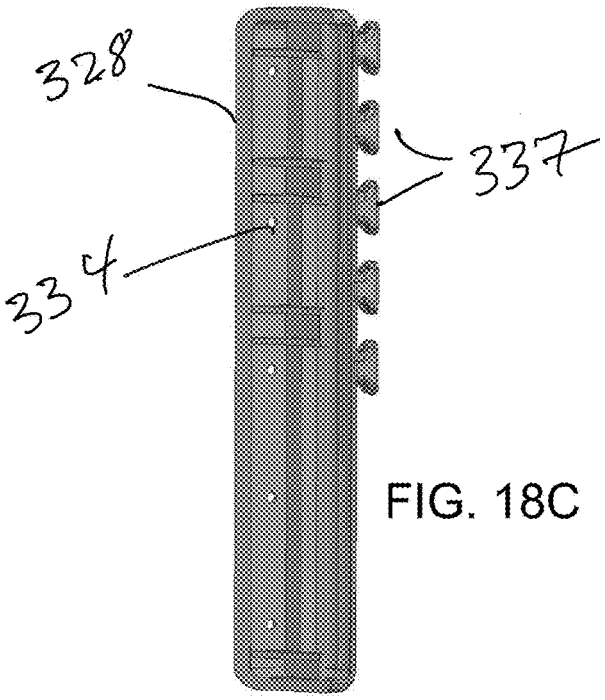
Figure 18D:
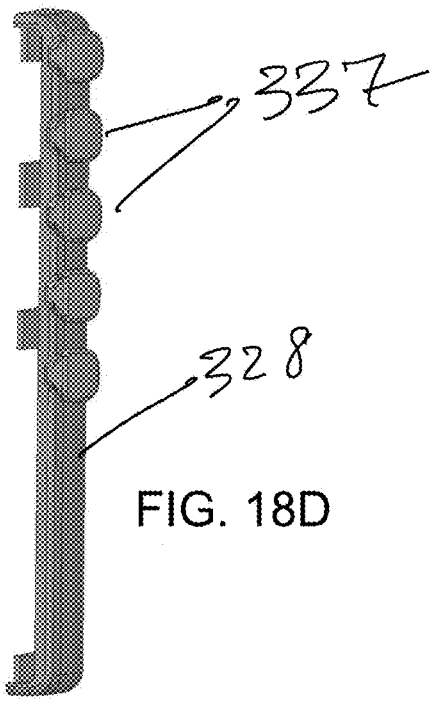
Figure 19A:
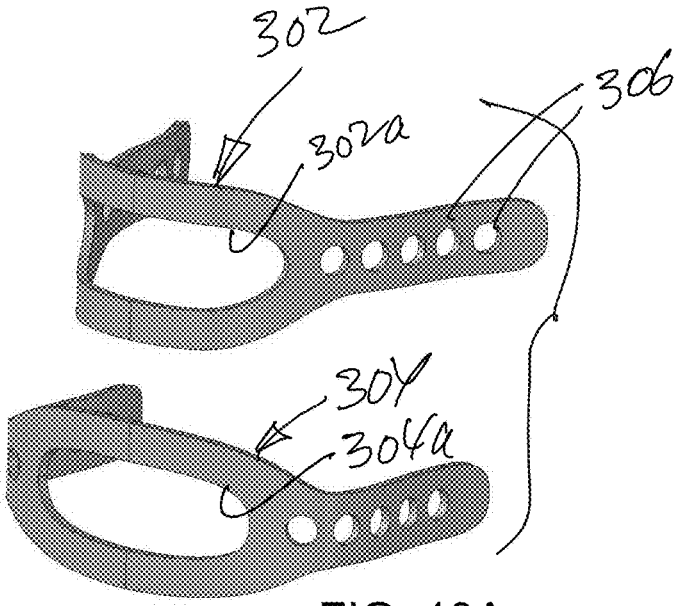
Figure 19B:
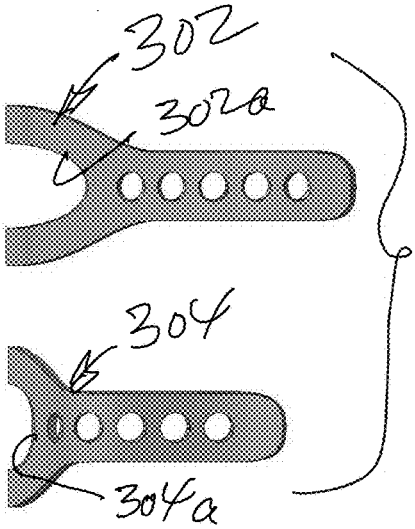
Figure 19C:
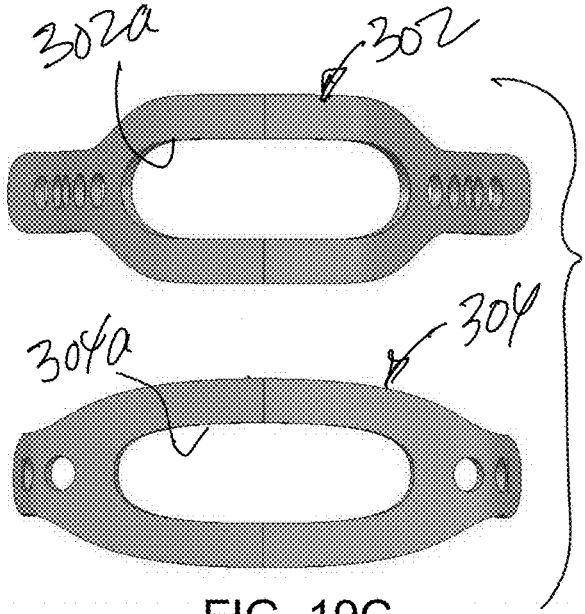
Figure 19D:
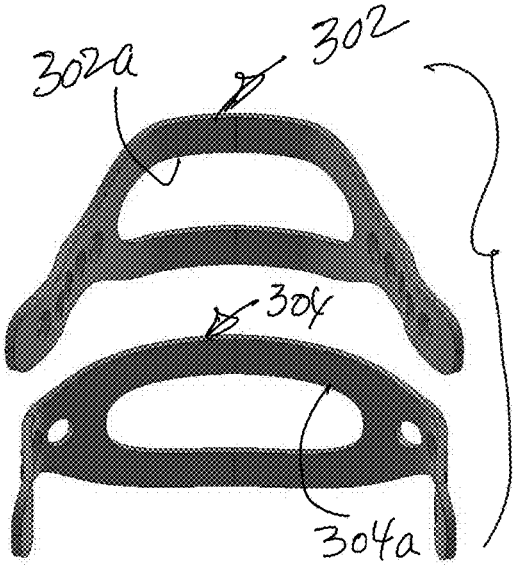
Figure 19E:
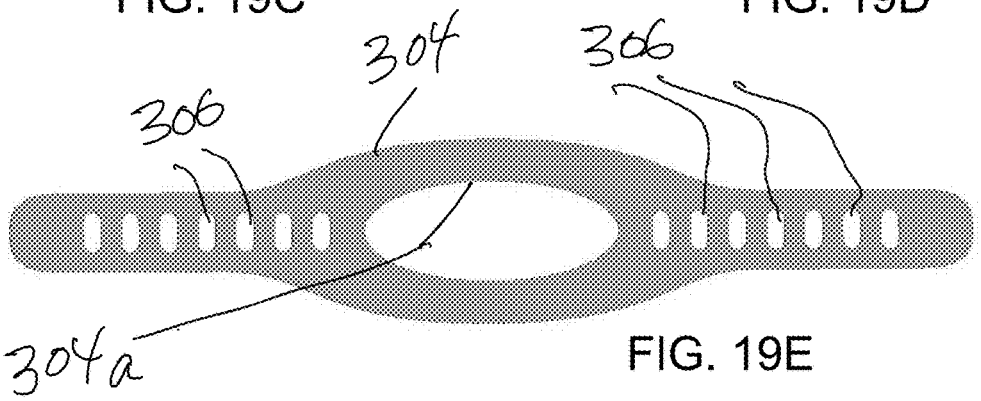
Figure 20A:
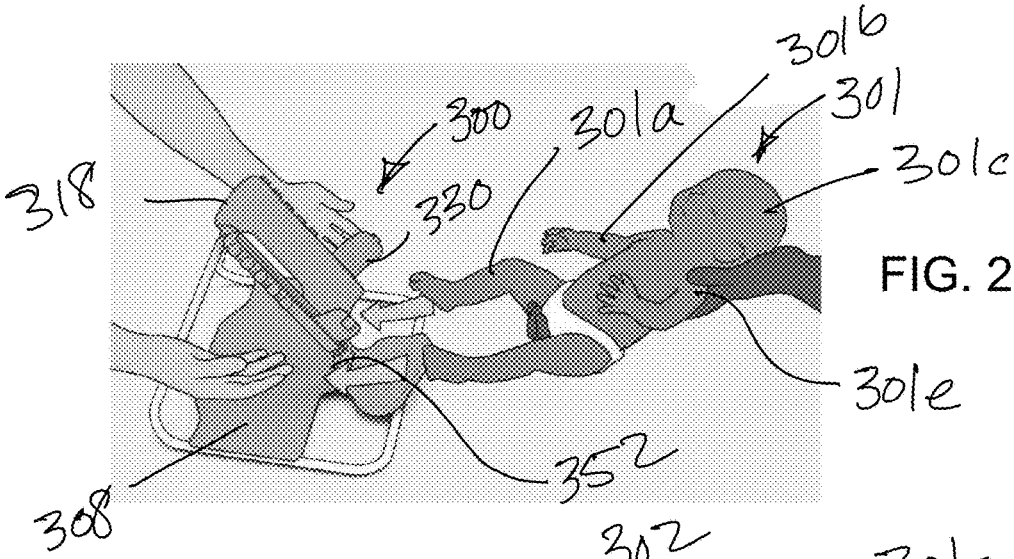
Figure 20B:
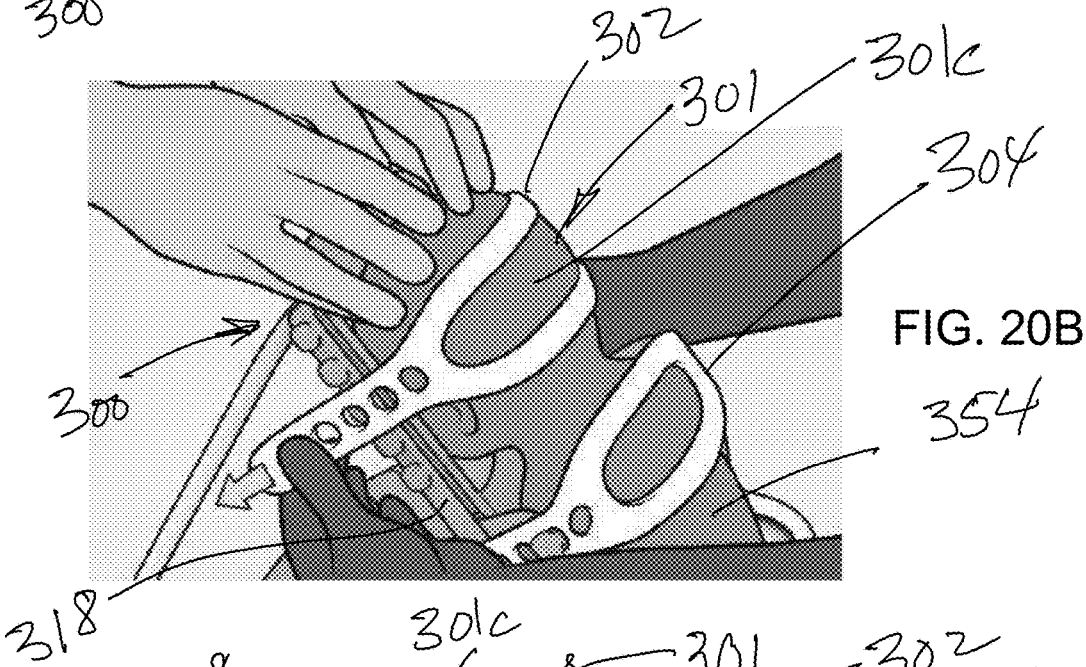
Figure 20C:
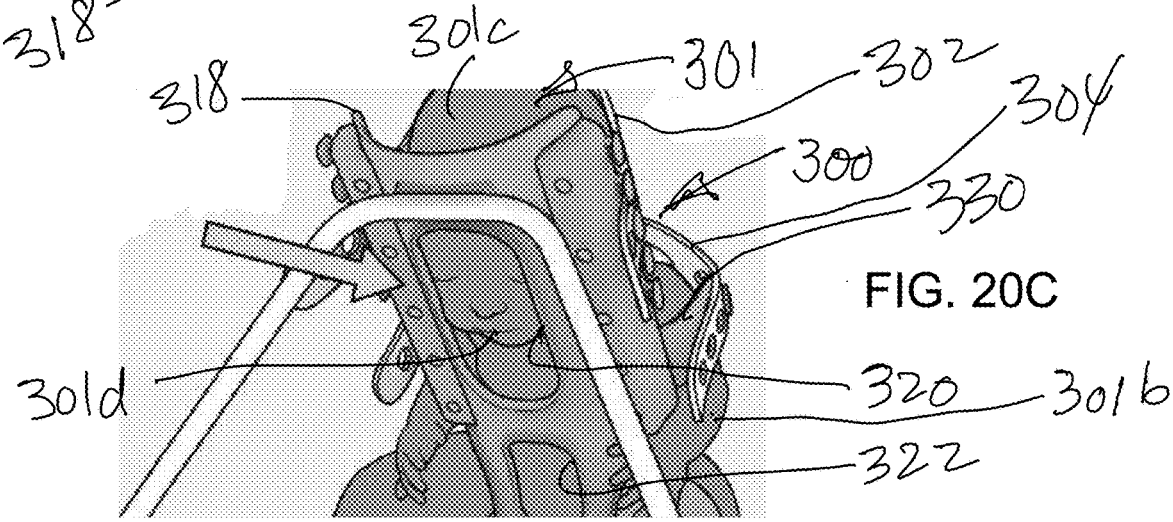

FIGS. 12A-D show different views of yet another embodiment of the present invention;

FIGS. 13A-B show perspective view of the embodiment of FIGS. 12A-D with an infant patient secured therein;

FIGS. 14A-C show different views of the base of the embodiment of FIG. 12;

FIGS. 15A-B show different views of the floor of the embodiment of FIG. 12;

FIGS. 16A-D show different views of the back chassis of the embodiment of FIG. 12;

FIGS. 17A-C show various views of a shoulder guard of the embodiment of FIG. 12;

FIG. 18A shows a front view of the left cap of the embodiment of FIG. 12 while FIGS. 18B-D show different views of the right cap of the embodiment of FIG. 12;

FIGS. 19A-D show various views of the head strap and back strap of the embodiment of FIG. 12 with round holes while FIG. 19E shows a further embodiment of the strap with oblong holes; and FIGS. 20A-C show various steps for use of the device of the embodiment of FIG. 12.

DESCRIPTION OF THE INVENTION

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal. Further, for ease of discussion, the present invention is discussed in connection with infants and lumbar puncture procedures, however the instant device can be used with patients of any age or size and for any number of medical, or non-medical, procedures.

The present invention provides new and novel infant stabilizer devices that can repeatably maintain an infant, or patient of any age, in the proper position during a medical procedure, such as a lumbar puncture, while permitting unimpeded ventilation and breathing for the infant.

In one exemplary embodiment, the present disclosure is directed to an infant positioning device 100 for stabilizing and maintaining an infant 110 in a fixed position for a lumbar puncture procedure. The device 100 can consist of a frame 120 with openings 125, 126 for the infant's face and abdomen to support the infant 110 in the proper position for the procedure and allow for unimpeded ventilation, to ensure that the infant can breathe properly during the procedure. Further, a component of the frame can be provided to secure and stabilize the infant within the frame to prevent movement during the procedure. Moreover, the device can include a stand attachment 130 to the frame that allows the frame to be free-standing.

In a first embodiment, as shown in FIGS. 1-5, an infant positioning stabilizer 100 is provided. The infant positioning stabilizer 100 can stabilize and maintain an infant 110 in a fixed position during a medical procedure. As noted above, one such medical procedure is a lumbar puncture. During the lumbar puncture procedure, it is imperative that the infant 110 is secured in a fixed fashion so that they do not move. Such movements can compromise the results of the test or cause injury to the infant. In general, the device 100 includes a frame 120 for positioning the infant 110 in the appropriate position and a stand attachment 130 for allowing the frame 120 to be self-standing and to be oriented at an angle appropriate to the medical procedure being performed. The attachment stand, attachment, or stand, 130 can be mounted or otherwise connected at an appropriate angle relative to the frame 120 to enable the device 100 to stabilize and maintain the infant 110 in the appropriate position throughout the duration of a medical procedure.

The attachment stand 130 can preferably be in the form of a stand that is secured to the frame 120 by fasteners (not shown), and the like. The attachment 130 can be formed of metal, or other rigid materials, in a generally "U" shape. The ends 131*a*, 131*b* of the attachment 130, can be formed as a generally triangular shape that can serve as anchor points 132*a*, 132*b* to be inserted into slots 122*a*, 122*b* on a rear side 121*r* of the upper portion 121 of the frame 120. The attachment 130 can be angularly adjustable, relative to the frame 120, within the slots 122*a*, 122*b*, to permit the angle of the frame 120 to be adjusted for a given procedure. Additionally, or alternatively, the attachment stand 130 may be selectively angularly locked relative to the frame 120. In a further alternative the attachment stand 130 may also be integrally formed with the frame 120.

Figure 1:
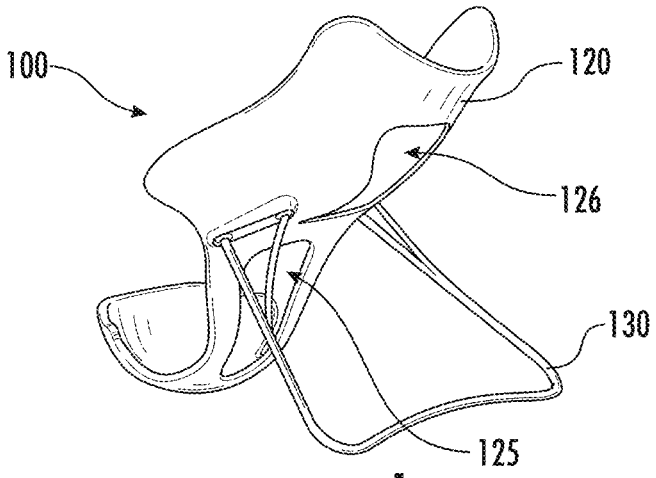
FIG. 1 is a rear three-quarters perspective view of the frame, frame openings, and stand attachment of the infant stabilizer of the present invention.
Figure 2:
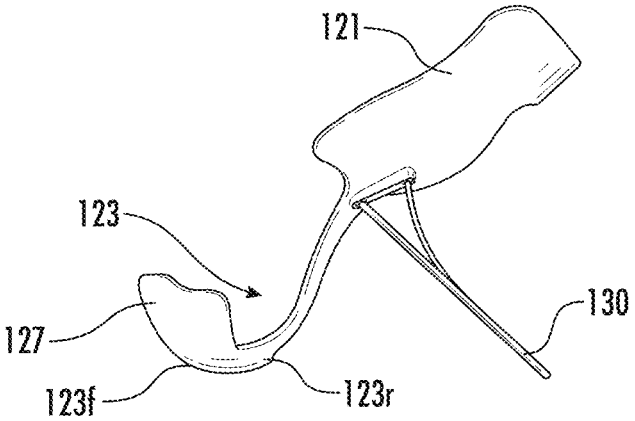
FIG. 2 is a side profile view of the frame and stand attachment of the infant stabilizer of FIG. 1.
Figure 3:
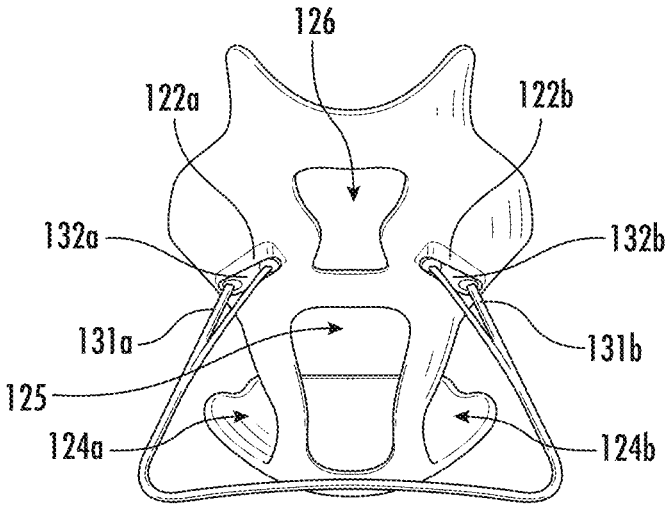
FIG. 3 is a rear perspective view of the frame, frame openings, and stand attachment of the infant stabilizer of FIG. 1.
Figure 4:
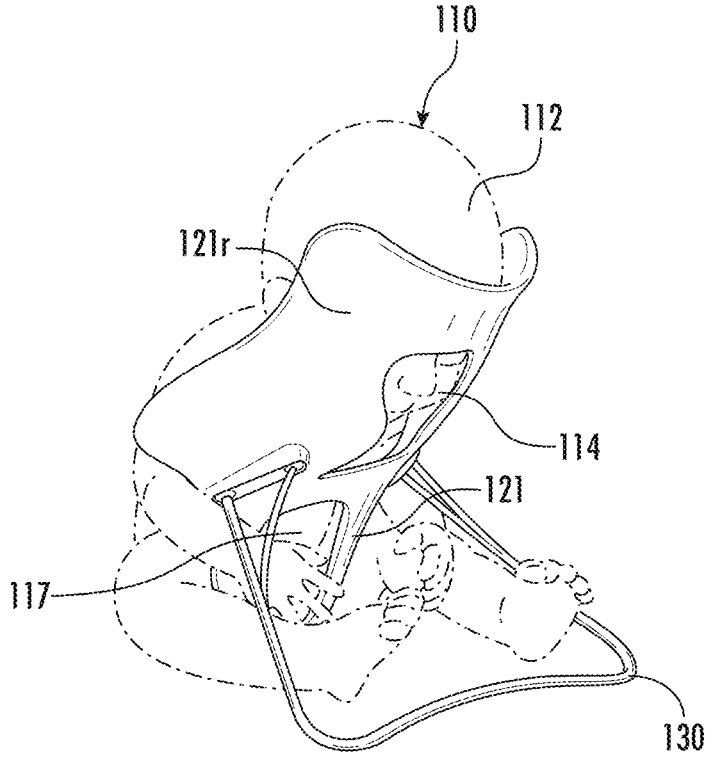
FIGS. 4 and 5 shows the infant stabilizer device of the present invention in use.

The frame 120 can, advantageously, be designed to provide both ergonomic comfort and proper positioning for the infant 110, as shown in at least FIG. 4. As can also be seen in FIGS. 1-3, the frame 120 can generally include a bottom portion 123 that has a generally bowl shape, including two leg cut outs 124*a*, 124*b* and an abdomen opening 125. Extending upward from a front 123*f* of the bottom portion can be a stop 127 that can prevent the infant 110 from sliding backward out of the bottom portion 123. Additionally, or alternatively, extending upward from a rear 123*r* of the bottom portion 123 can be the upper portion 121 of the frame 120. Similar to the bottom portion 123, the upper portion 121 can have a "U" shaped cross-section to ergonomically cradle the infant's head 112 and shoulders/torso 116 and a corresponding facial opening 126 to allow the infant's face 114 to be exposed to allow for unimpeded breathing. In the illustrated embodiment, the frame 120 is an integral assembly where the upper and bottom portions 121, 123 are formed as a single piece. The frame 120 can be formed of a variety of materials including rigid plastics, or other materials which can be sterilized. In some embodiments, the frame 120 can include padding on a front face to provide additional comfort to the infant 110 being strapped to the frame.

Figure 5:
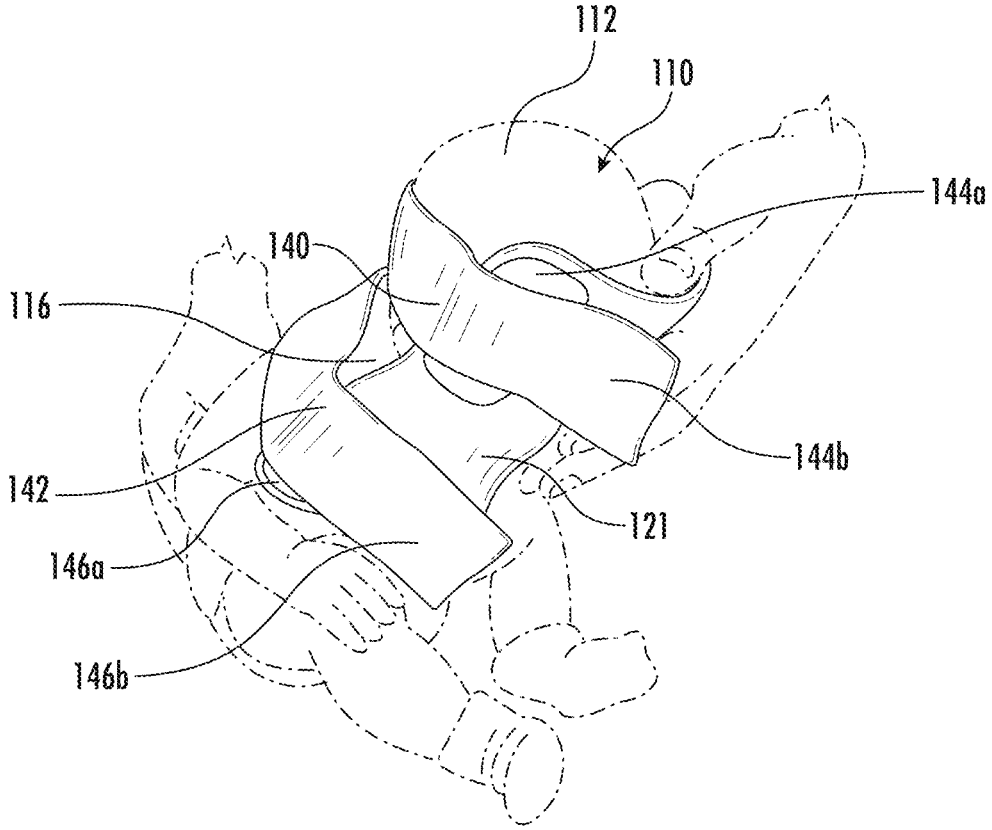

In some embodiments, as shown in FIG. 5, the device 100 may employ an upper strap 140 and a lower strap 142. The straps 140, 142 can have one side made of a soft material which can be secured for example by hook and loop fasteners 144*a*, 144*b*, 146*a*, 146*b*. The fasteners 144*a,b*, 146*a, b*, are placed on the rear of the upper portion 121 to allow for adjustable attachment of the straps 140, 142. As shown in FIG. 5, the upper strap 140 can be used to secure the head 112 of the infant 110 and the lower strap 142 can be used to secure the infant's torso 116. Of note, in FIG. 5, the attachment stand 130 is removed for ease of illustration purposes only.

In one exemplary method of use, as shown in FIGS. 4 and 5, the infant 110 can be placed to face forward into the frame 120 that is supported at a desired angle by the attachment stand 130. The infant 110 can be positioned so that the openings 125, 126 in the frame 120 are aligned with the face 114 and abdomen 117 to ensure the infant's face 114 and abdomen 117 are appropriately situated, as best seen in FIGS. 4 and 5. Once the infant 110 is in the desired position, as in FIG. 5, the straps 140, 142 can be secured in place. The infant 110 is thus stabilized, using the attachment(s) to the frame to ensure minimal movement of the infant's head 112 and body, or torso, 116. The frame component 120 along with the attachment stand 130 achieves the desired angle to the ground for a procedure, such as a lumbar puncture, and to ensure that the frame 120 is self-standing during the lumbar puncture.

A second embodiment of a self-standing infant stabilizer device 200 is shown in FIGS. 6-11. The second embodiment 200 provides for a larger number of adjustments for the device to accommodate a larger number of sizes of infants. In the illustrate embodiment, the frame, or static frame, 220 can include an upper and lower frame portions 221, 223 and a slide frame 250 which is a separate part that can slide relative to the frame 220. Additionally, the device 200 can include slidable straps 240*a*, 240*b*, 242*a*, 242*b* which can vertically slide relative to the slide frame 250. Thus, the device 200 can provide for added adjustments as compared to the single use size of the device 100.

The frame 220 of the device 200 can, like the device 100 above, cradle and support an infant for a variety of medical procedures, including a lumbar puncture. The infant 110 is placed on the frame 220 in similar fashion to frame 120 of the first embodiment 100 of the present invention. The frame 220 can be made of various materials include of plastics or metals that can be easily and quickly sanitized for multiple uses. The frame 220 can be a single unitary piece made from a single piece of material. The lower frame portion 223 can have a generally bowl shape including an upper backing or stop 227 extending from the front 223*f* of the device 200 to prevent the infant from sliding out. At the rear 223*r* of the frame 220, the lower frame portion 223 can have two leg cut outs 242*a*, 242*b* sized to receive the legs of the infant. The frame 220 can additionally include an abdomen opening 225 that allows for the infant to breathe regularly. Extending up from above the abdomen opening can be an upper u-shaped frame 221.

Figure 8:
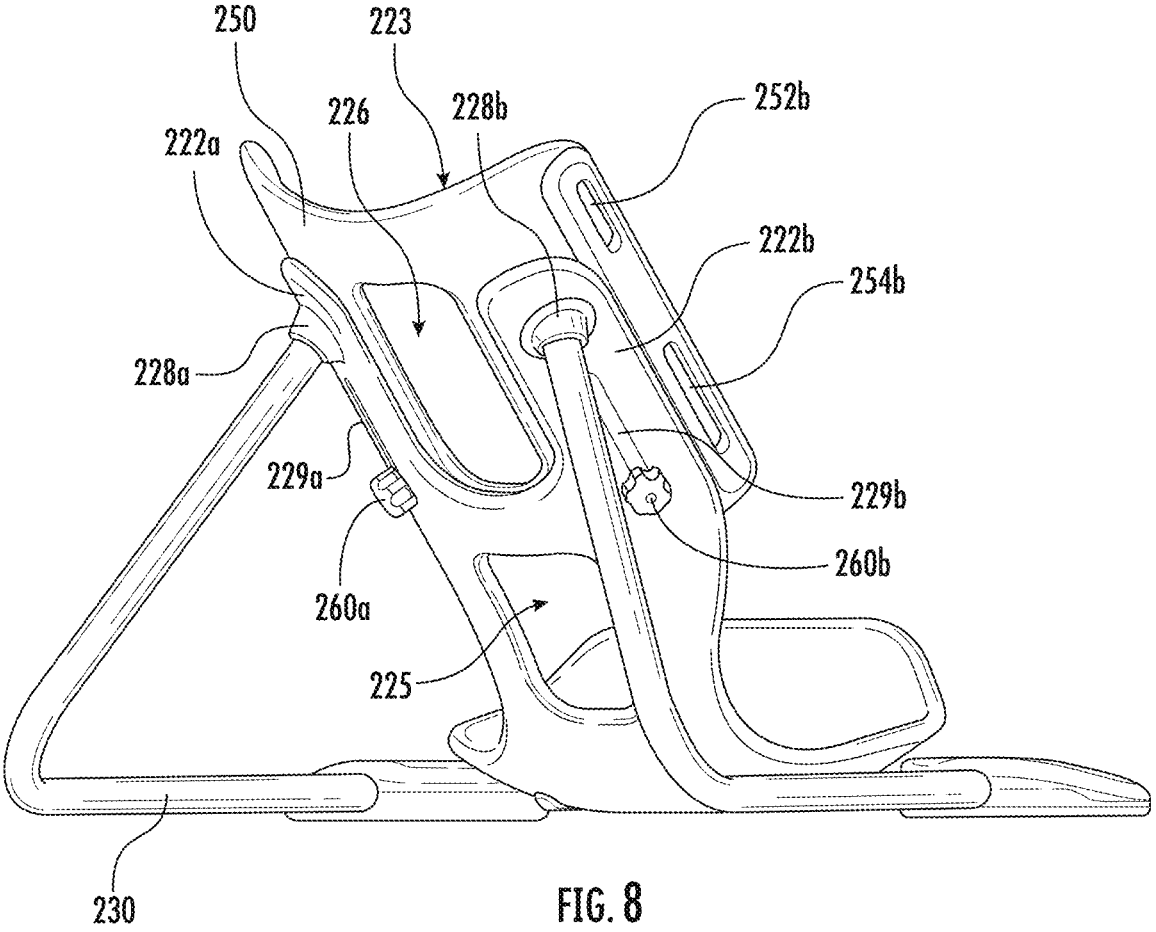
FIG. 8 is a rear perspective view of the second embodiment of the infant stabilizer according to FIG. 6 with various components removed for illustration purposes.
Figure 9:
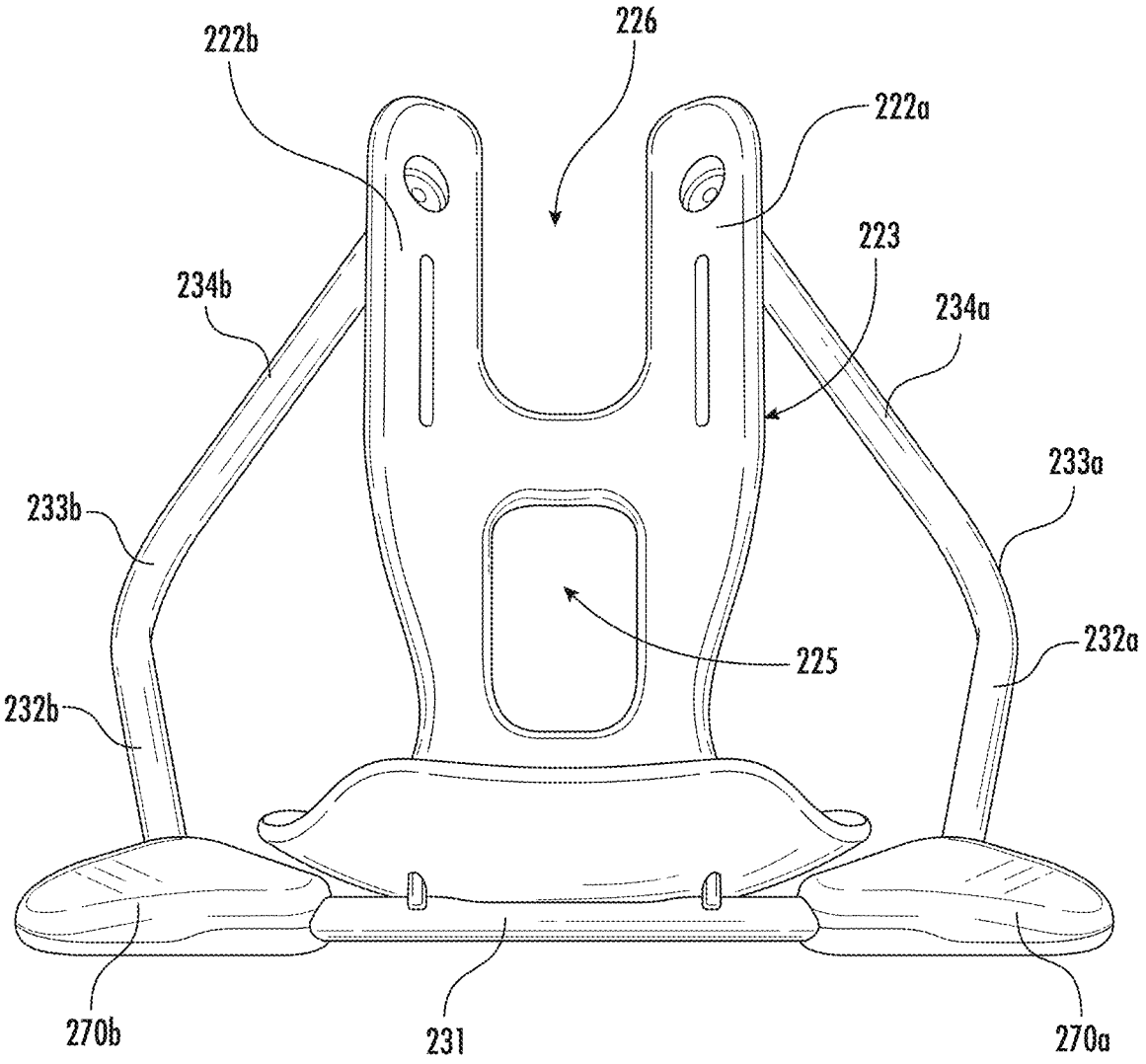
FIG. 9 is a front view of the infant stabilizer according to FIG. 6 with various components removed for illustration purposes.
Figure 10:
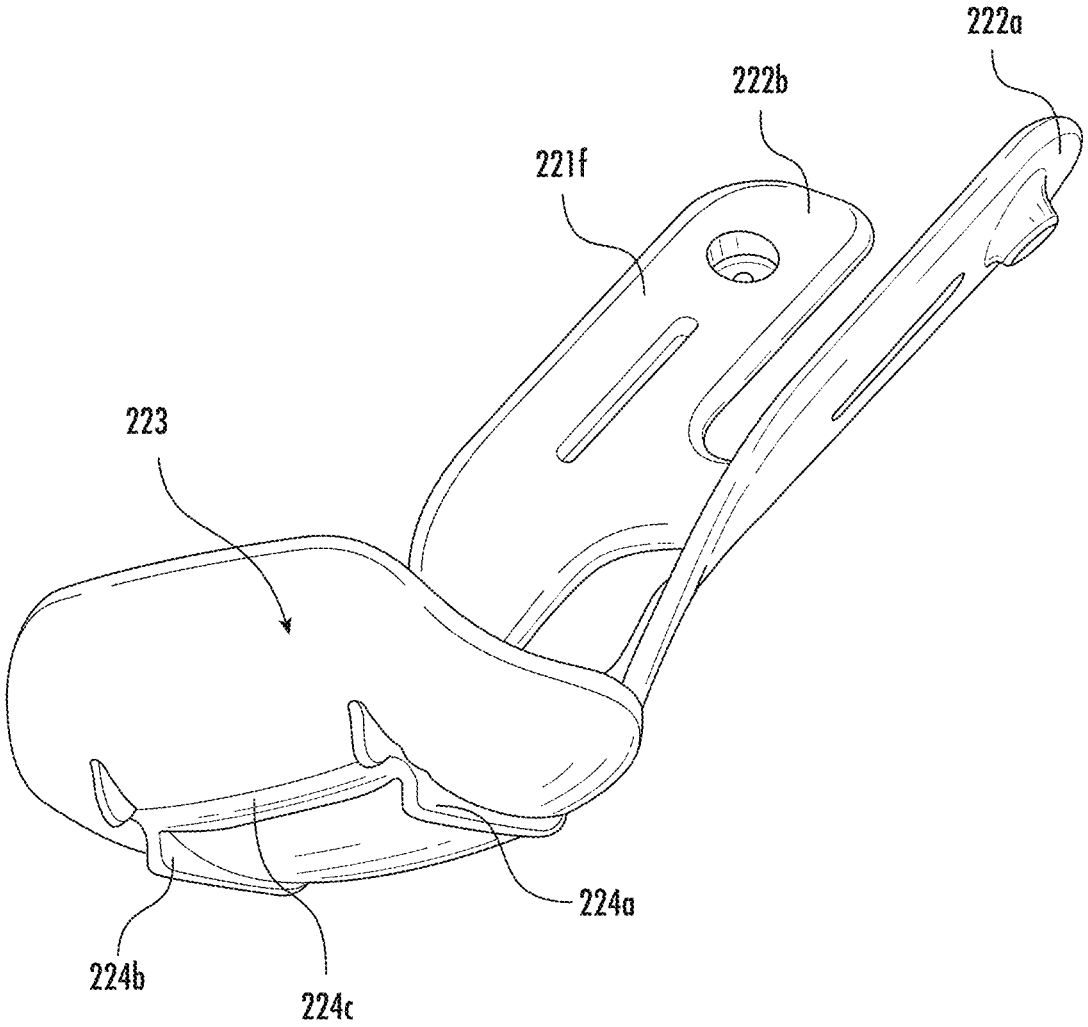
FIG. 10 is a bottom perspective view of the lower frame of the second embodiment of the infant stabilizer according to FIG. 6.

As best seen in FIG. 8, the upper U-shaped frame 221 can include a first and second uprights 222*a*, 222*b* that define a facial opening 226. The facial opening 226 can provide for a place for the infant's face to be located to provide a clear breathing airway. On a rear face of the first and second uprights 222*a*, 222*b* anchor points 228*a*, 228*b* for attachment stand 230 can be disposed and will be discussed in detail below with respect to the attachment stand 230. The first and second uprights 222*a*, 222*b* can additionally include respective grooves 229*a*, 229*b*, below the respective anchor point 228*a*, 228*b*. The respective grooves 229*a*, 229*b* that are obround, or stadium, in shape and can be sized to slidably receive a compression screw and knob 260*a*, 260*b* extending therethrough to slidably secure the slide frame 250. The length of the grooves 229*a*, 229*b* define the amount of vertical adjustment the slide frame 250 can move relative to the frame 222. The compression screws 260*a*, 260*b* can be received in a respective threaded through hole 262*a*, 262*b* on the rear of the slide frame 250, as shown in FIG. 11.

Figure 6:
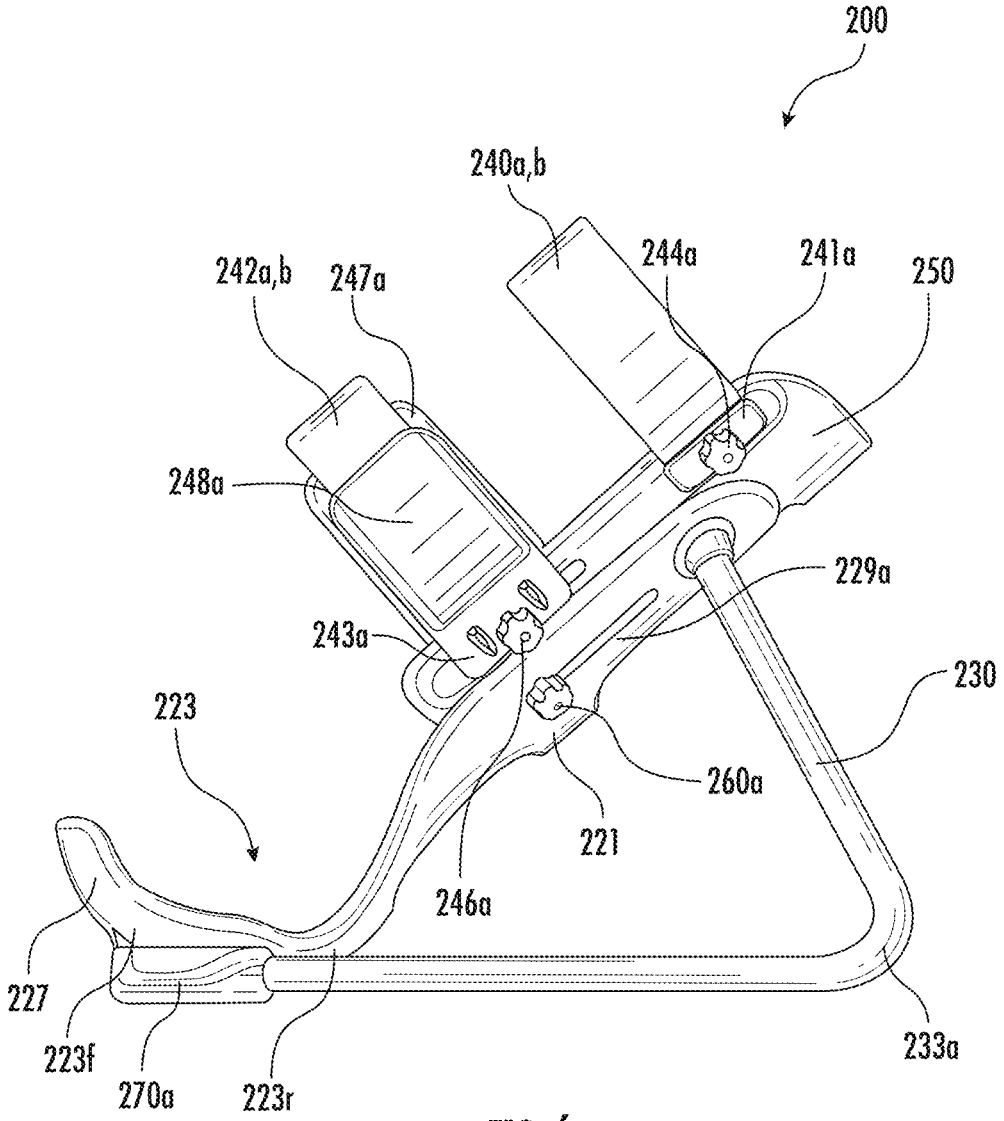
FIG. 6 is a side view of an infant stabilizer according to a second embodiment of the present invention.
Figure 7:
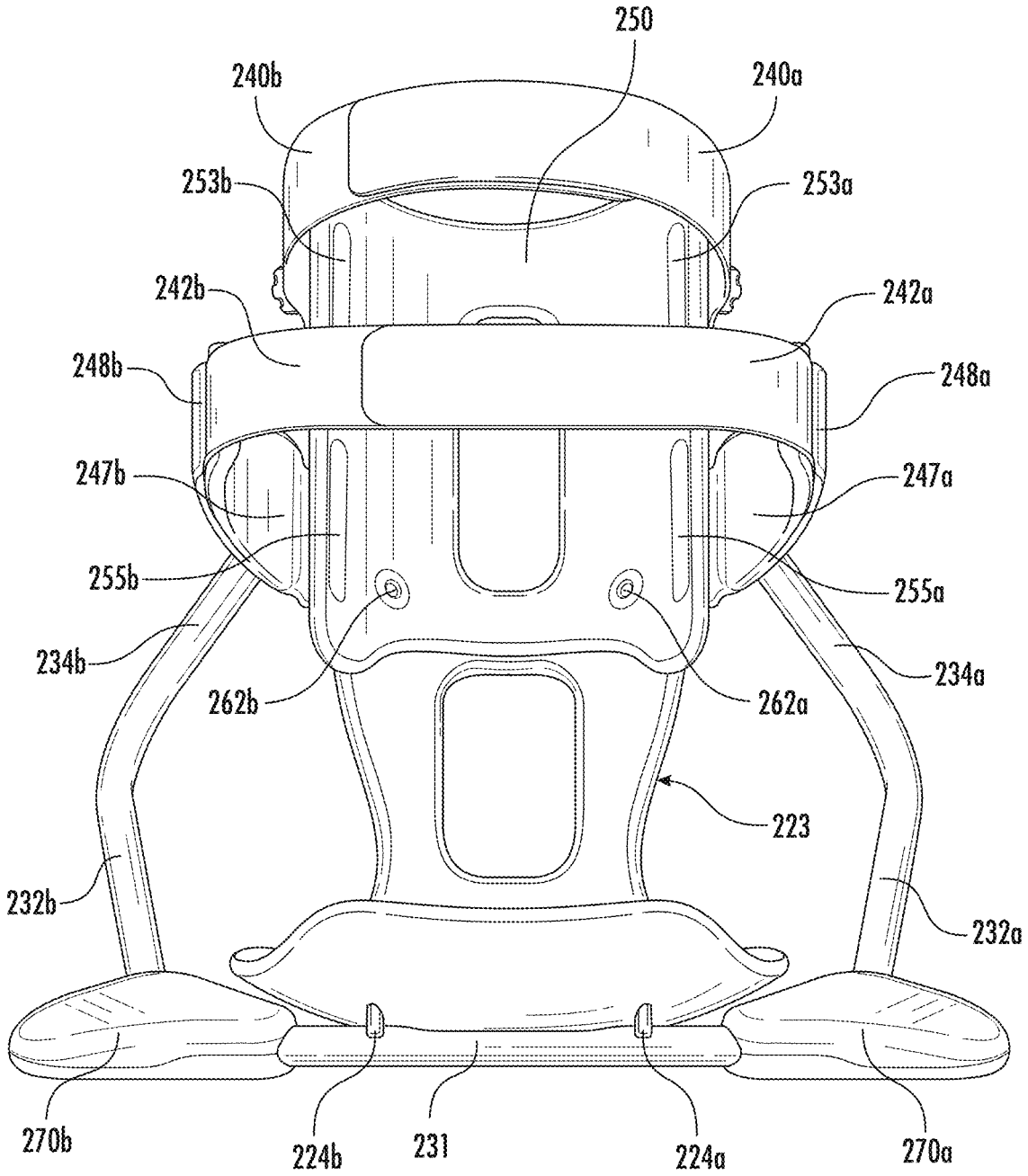
FIG. 7 is a front view of the second embodiment of the infant stabilizer according to FIG. 6.

As illustrated in FIGS. 6 and 7, the slide frame 250 is designed to be vertically adjustable relative to the frame 220 to accommodate children of a variety of sizes. Advantageously, with an adjustable stabilizer device 200, precious storage room can be saved as a plurality of sized stabilizers in a plurality of sizes are not required. In addition, or alternative, to the slide frame 250 being vertically adjustable, the two sets of straps 240*a*, 240*b*, 242*a*, 242*b* can be vertically adjustable relative to the slide frame 250 and the other of the straps. Thus, due to the adjustability of the slide frame 250 and the straps 240*a*, 240*b*, 242*a*, 242*b*, the overall device 200 can accommodate infants of various sizes, body shapes, and other medical considerations (e.g. a problematically placed port or sensors).

Figure 11:
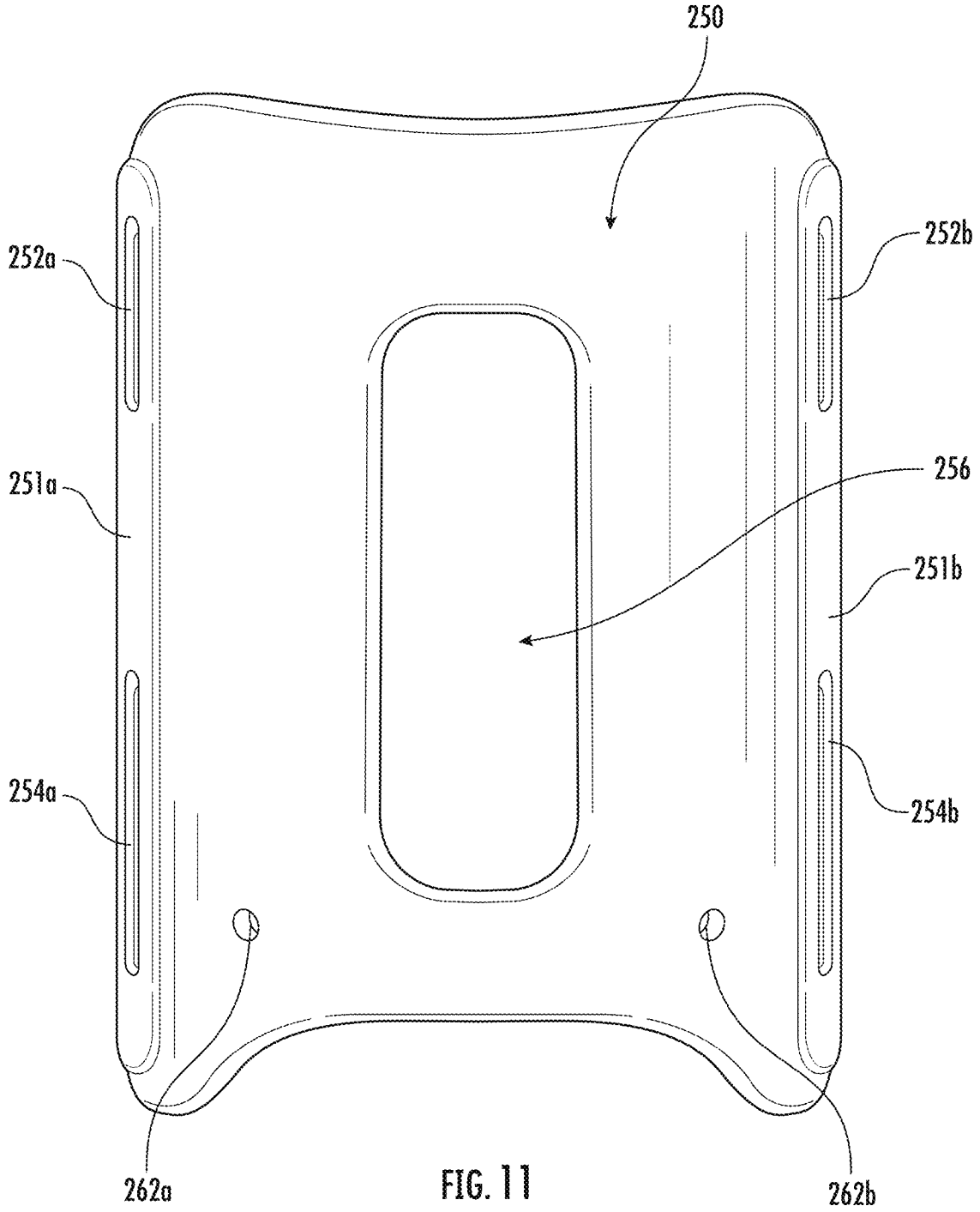
FIG. 11 is a rear view of the slide frame of the second embodiment of infant stabilizer according to FIG. 6.

As seen in FIG. 11, the slide frame 250 can be of a rectangular shape with rounded corners having a corresponding U-Shape in cross section to match the upper portion 221 of the frame 220. The slide frame 250 is designed to sit and ride on the front face 221*f* of the upper frame portion 221 and is retained to the upper frame by the compression screws with knobs 260*a*, 260*b* being received in respective threaded through holes 262*a*, 262*b*. The compression screws 260*a*, 260*b* can be inserted from the rear of the upper frame 212 through respective slots 229*a, b* into the threaded through holes 262*a*, 262*b* of the slide frame 250. Once the desired height is reached the knobs 260*a*, 260*b* can be turned to tighten and thus fix the slide frame 250 relative to the upper frame 212. Similar to the upper frame 212, the slide frame 250 can include a facial opening 256 to permit easy breathing for the infant.

Referring back to FIGS. 6 and 7, in order to retain the infant in the device 200, two sets of straps 240*a*, 240*b*, 242*a*, 242*b*, or more, can be provided to secure the infants head and the infants torso. In some embodiments, as shown in FIGS. 1-5, the straps can be fixed relative the frame 220. In the illustrated embodiment of FIGS. 6-11, an upper set of slots 252*a*, 252*b* and a lower set of slots 254*a*, 254*b* on the left and right edges 251*a*, 251*b* of the slide frame 250 are provided to allow the straps 240*a*, 240*b*, 242*a*, 242*b* to be vertically adjusted for the proper height of the child. The upper left and right straps 240*a*, 240*b* can each have a distal end with a retaining plate 241*a*, (only one side is shown) having a through hole (not shown) to receive a compression screw 244*a*. The upper compression screws 244*a* can be inserted from the rear of the slide frame 250 into the respective retaining plate 241*a* and slid up or down within the respective slot 252*a*, 252*b*. While only one side of the compression screws 244*a* and plates 241*a* are shown, one of ordinary skill in the art will understand that the opposite strap has the same structure. When the respective compression screws 244*a* are tightened, they can fix the respective plate 241*a* and thus the strap 240*a*, 240*b* at a given height. The compression fit fixes the plate 241*a* and thus the strap 240*a*, 240*b* at the chosen height. In the illustrated embodiment, a respective plate 241*a* can be located on the back of the slide frame 250 and a respective cap 253*a*, 253*b* can be inserted from the front to cover the compression screw 244*a* to prevent any injury to the infant. In some embodiments, as illustrated, the straps 240*a*, 240*b* can be cushioned on a rear face to provide comfort to the child and can be fastened to one another via hook and loop fasteners, or similar mechanical or magnetic fasteners (not shown).

The lower straps 242*a*, 242*b* can be substantially the same as the upper straps with the inclusion of included cushion pads 247*a*, 247*b* to cushion around the infant's torso and outer plates 248*a* that are larger to retain the straps shape around the torso when loading the infant into the device. The lower left and right straps 242*a*, 242*b* can each have a distal end with a retaining plate 243*a* (only one is shown) having a through hole (not shown) to receive a compression screw 246*a* (only one is shown). The respective lower compression screws 246*a* can be inserted from the rear of the slide frame 250 into the respective retaining plate 243*a* and slid up or down within the respective slot 254*a*, 254*b*. When the respective compression screws 246*a* are tightened, they can fix the respective lower plate 243*a* and thus the lower straps 242*a*, 242*b* at a given height. The compression fit fixes the plate 243*a* and thus the strap 242*a*, 242*b* at the chosen height. In the illustrated embodiment, a respective plate 243*a* can be located on the back of the slide frame 250 and a respective cap 255*a*, 255*b* can be inserted from the front to cover the compression screw 246*a* to prevent any injury to the infant. In some embodiments, the straps 242*a*, 242*b* can be fastened to one another via hook and loop fasteners, or similar mechanical or magnetic fasteners (not shown).

In some embodiments, the attachment stand 230 can be substantially the same as the attachment stand above. Alternatively, as shown in the illustrated embodiment, the attachment stand 230 can be a modified "U" shaped stand with two plastic support feet 270*a*, 270*b*. The modified "U" shaped frame can include a central base portion 231 having two legs 232*a*, 232*b* extending rearwardly and outward (relative to a line that extends perpendicular to the central base portion). Each of the legs includes upright supports 234*a*, 234*b* that extend forward and inward towards a distal end. The attachment stand 230 can be formed with a cylindrical cross section and the distal ends can be received in anchor holes on the upper frame. At the bend point 233*a*, 233*b* from the central base portion to the two respective legs 232*a*, 232*b*, the assembly can include plastic support feet 270 that include an internal channel for receiving the stand. The support feet 270 can provide for added stabilization, thought they are not required. Additionally, or alternatively, the lower portion 223 of the frame can include two offset projections 224*a*, 224*b* and a channel 224*c* extending therebetween to capture a portion of the central base portion 231 where the lower portion 223 rests thereon.

In use, as in FIGS. 6 and 7, an infant can be placed in the device 200 before or after the adjustment of the device. The knobs 260*a*, 260*b* for the slide frame 250 can be loosened, but not removed, to allow the slide frame 250 to be adjusted up or down, as needed, relative to the frame 200. Once the slide frame 250 is in the appropriate location the knobs 260*a*, 260*b* can be turned in the opposite direction to lock the slide frame 250 in place. Similarly, one or both sets of straps 240*a*, 240*b*, 242*a*, 242*b*, or just one strap, can be adjusted by rotating the respective knob clockwise, or counterclockwise, to loosen the connection and allow for sliding movement through the respective slots up or down. Again, once the desired location in the slot is achieved, the respective knob can be tightened to secure the location of the strap 240*a*, 240*b*, 242*a*, 242*b* relative to the slide frame 250 and the frame 220. Once the adjustments are complete, a user can place the infant, face first, into the device 200. The user will ensure that the infant's face is disposed in the openings 226, 256 and the abdomen is disposed in the abdomen opening 225, all to ensure that the infant's ability to breath is not hindered. The user can then use the upper straps 240*a*, 240*b* to retain the infant's head and the lower straps 242*a*, 242*b* to retain the infant's torso. Once secured to the device 200, the medical procedure can begin with the infant being held still during the lumbar puncture, for example, to eliminate human error and to optimize the success of the procedure. Advantageously, the instant devices 100, 200 can improve the rates of non-traumatic lumber punctures while maintaining the infant's ability to breathe comfortably—thus maintaining the infant in a secure upright position which has been shown to be better positioning for maximal width of spinal fluid column. These advantages during the procedure can lead to lower costs and shorter hospital stays.

Referring now to FIGS. 12-22, another embodiment 300 of the infant stabilizer of the present invention is shown in detail. This additional embodiment 300 of the present invention also provides a cradle type device with soft straps, which are preferably made of biocompatible foam, but could be made of other materials, such as neoprene, and the like, for securing the infant during a medical procedure, such as spinal taps and lumbar punctures. It provides additional customization to provide additional comfort and control of the patient during the medical procedure. As noted above in connection with the other embodiments, the embodiment 300 present invention is configured for use during medical procedures such a spinal related procedures including spinal taps and the like to gently hold a patient 301, such as an infant, in position. The upper opening is configured to ensure unobstructed breathing and optional feeding during the procedure, such as with a dextrose solution.

More specifically, FIGS. 12A-D show different views of this additional embodiment 300 of the device of the present invention. FIGS. 13A-B are views of the embodiment of FIGS. 12A-D with an infant patient secured therein. FIG. 12A shows the use of straps 302, 304 with holes 306 are round in shape but it is preferred for the holes 306 to be oblong in shape, as seen in FIGS. 13A and 19E.

A floor 308 and seat component 310, preferably with a flat floor 308, is secured to a stand 312, which is preferably of tubular metal, as seen in FIGS. 14A-C. The floor 308 and seat component 310 is shown in detail in FIGS. 15A-B. The floor 308 is preferably substantially flat and is integrally molded with the seat portion 310 but could be separately formed. The floor 308 and seat component 310 is preferably secured to the stand 312 with threaded fasteners 314, such as screws, or the like, as seen in the bottom view of FIG. 12D using one or more the holes 316 through the stand. For example, the screws may be #6-32 screws. The floor 308 and seat component 310 are preferably molded plastic. The stand 312 includes a number of holes 316 therethrough that can be used for various purposes. For example, as seen in FIG. 13A, rubber feet or "buttons" 318 can be inserted into the holes 316 form the bottom of the stand for anti-skid and cushioning purposes.

FIGS. 16A-D show different views of the chassis 318 of the embodiment 300, of FIG. 12. The chassis 318 is secured to the floor 308 and seat component 310*t* at a lower connection point. The chassis 318 has a substantial curved shape to accommodate the shape of the body of the infant 301 to be secured for a comfortable fit. The chassis 318 preferably has an upper opening 320 and a lower opening 322 to facilitate access to the patient 301, such as the mouth during the procedure without having to remove the straps 302, 304 and disrupt the patient 301. The chassis 318 includes structures 324 on the opposing sides to receive the left cap 326 and right side cap 328 and to also capture the shoulder guards 330 therebetween. The chassis 318 is preferably molded plastic.

The left cap 326 of FIG. 18A is secured to the left side of the chassis 318 while the right cap 328 of FIG. 18B is secured to the right side of the chassis 318 by fasteners 332, such as screws, or the like, via holes 334 in the caps 326, 328. The screws 332 may be #4-40 screws, for example. A shoulder guard 330 of FIG. 17A is captured between the right cap 328 of FIG. 18B and the right side of the chassis 318. A second shoulder guard 330 of FIG. 17A is captured between the left cap 326 of FIG. 18A and the left side of the chassis 318. The shoulder guards 330 are preferably of the same shape and configuration but they could have a special shape for each side of the device. The shoulder guards 330 are preferably molded plastic. Posts 336 are provided on the shoulder guards 330.

The capturing of the shoulder guards 330 can be seen in FIGS. 12A-D and the slot 338 through which it can travel can also be seen. Since the shoulder guards 330 are mirror images of each other, the right side shoulder guard 330 will be discussed for ease of reference. The shoulder guard 330 of FIGS. 17A-C includes a flange portion 340 that has a detent 342 on an inner edge 344, which is to be captured between the caps 326, 328 and the chassis 318. This detent 342 releasably engages with an array of seats 346 present on a ratchet-like member on the sides of the chassis 318 thereby effectively providing a releasable locking of the shoulder guards 330 relative to the chassis 318. This releasable locking using a detent 342 and ratchet seats 346 on the chassis 318 is easier and faster than using threaded fasteners to secure the shoulder guards 330 in place to the chassis.

When a shoulder guard 330 is captured and secured against the side of the chassis 318 by a cap 326, 328, the detent 342 releasably resides in one of the ratchet seats 346. Thus, the shoulder guards 330 may be adjusted vertically along length of the side of chassis 318 in the slot 338 so that the to-be-installed back strap 304 is optimally located on the patient 301. The slot 338 may or may not run the entire vertical length of the chassis 318. To move a shoulder guard 330, it is pulled laterally inward away from the chassis 318 to lift the detent 342 out of a given seat 346 to enable the guard 330 to be slid vertically so that the detent 342 may be installed in another chassis seat 346. The laterally outside edge of the guards 330 carry a post 336, as discussed above, to releasably receive a free end of the back strap 304. The shoulder guards 330 are preferably molded plastic.

Turning now to FIGS. 19A-D, various views of the head strap 302 and back strap 304 pairs of the embodiment 300 of FIGS. 12A-D where the only the head strap 302 and back strap 304 are shown for illustration purposes only. The top image of each of FIGS. 19A-D is the head strap 302 that engages with the posts 337 on the side caps 326, 328 that are attached to the chassis 318. The lower image shows the back strap 304, which is preferably substantially the same size as the head strap 302 but the back strap 304 and the head strap 302 can different sizes that each other. Also, the configuration of the head strap 302 and the back strap 304 can be configured differently where a center aperture 302*a* in the rear split portion of the head strap 302 can be wider to better accommodate the back of the head of the infant 301. Also, the split rear portion of back strap 304 can have a smaller opening 304*a* to better interface with the back of the infant 301. The free ends of the back strap 304 engage with the posts 336 on the shoulder guards. The straps 302, 304 of FIGS. 19A-D are provided with circular holes 306 but the holes 306 may be of any shape or configuration so they can releasably interconnect to the respective posts 336 on the shoulder guards and the posts 337 on the caps for the head strap 302. The straps 302, 304 are preferably biocompatible foam or could be any other compatible material.

It is preferred that the holes 306 are oblong in shape, as in seen in FIG. 19E. Thus, the free ends of straps 302, 304 may have either round, oblong or other shaped holes 306, or any combination thereof. Moreover, the posts 337 that receive the free ends of the head strap 302 and the posts 336 that receive the back strap 304 may be configured of any size and shape to best accommodate the free ends of the straps 302, 304. The figures herein show both oblong and round holes 306 for ease of illustration but it is not intended to limit the shape of the holes 306 to round, oblong or any other shape.

FIGS. 20A-C show various steps for use of the device of the embodiment 300 of FIGS. 12-19, as discussed in detail below. First, it should be understood that, before each use, the device 300 must be checked for damage. The user, such as medical practitioner, must determine whether the infant 301 is safe in the device 300 before the medical procedure is conducted. The infant 301 must never be left unattended and the device 300 of the present invention must be used in the upright position, as shown in the figures. Moreover, the device 300 should not be heat sterilized. Cleaning agents containing ketones, ether, or plastic solvents should not be used as they can damage the device of the present invention. The device 300 should be replace every two years. It is also possible that the device 30 may leave impressions on the infant's face.

Referring now to FIGS. 20A-C, step-by-step use of the device 300 of the present invention is shown and discussed in detail.

1. Make sure room is warm to ensure comfort of the infant 301, bring device 300 into the room before procedure to be warmed up to room temperature.
2. Place device 300 on a clean, leveled surface, away from edges of the surface. Verify device 300 will not fall off the surface.
3. Take the two straps 302, 304 out of the plastic packaging. Place the straps 302, 304 within easy reach.
4. It is preferred that a dextrose solution is prepared to feed the infant 301 while the infant 301 is secure in the device 300 of the present invention.
5. Undress the infant 301, leaving the diaper on so the infant 301 does not leave waste on the device.
6. Practitioner to hover the infant 301 into the device 300, while assistant slides the infant's legs 301*a* through leg openings 352 and onto the floor of the device 300, as seen in FIG. 20A (step 6).
7. Rest the infant's upper body towards the upper opening 320. The infant's arms 301*b* must be within the shoulder guards.
8. An assistant should gently hold the infant's head 301*c* against the upper opening 320 until the infant 301 is completely secured.
9. Verify that the infant's mouth 301*d* is within the upper opening 320. If the infant 301 cannot breathe correctly through the upper opening 320, the infant must be removed from the device 300.
10. Place pulse oximeter on the infant's body, such as to the toe, to verify that the infant 301 has proper oxygen level.

11. The height of the shoulder guards 302, 304 are adjusted such that the top edges of the shoulder guards 330 are just below the top of the infant's shoulders 301*e*.
12. Without tightening, place and center strap 304 across the infant's shoulders 301*e* and one strap across the infant's head 301*c*.
13. The infant 301 should not be left unattended while in the device 300.
14. Gently tighten the back strap 304, onto one post 336 on each side of the device 300 on shoulder guard 330, based on practitioner's judgement. Then verify that the infant 301 is breathing, as shown in FIG. 20B (step 14). The vertical location of the head strap 302 may be adjusted by securing it to a selected post 337 vertically along the chassis 318 where desired. The tension may be adjusted for the head strap 302 by selected the appropriate hole 306 on the strap 302 to receive the selected post 337. The vertical location of the back strap 304 is adjusted by sliding the entire shoulder guard 330 vertically, as discussed above. For tension, similar to the head strap 302, the appropriate hole 306 in the back strap 304 is selected for engagement with the post 336 on the shoulder guard 330. The straps 302, 304 are pulled over the post 336, 337 at the desired hole 306. The straps 302, 304 stretch to permit the straps 302, 304 to be routed over a post 336. 337.
15. Gently tighten the head strap 302, onto one hook 337 on each side of the device 300, such that the infant's head 320*c* is stable.
16. Verify that the infant 301 is breathing through the upper opening 320. If the infant 301 can't breathe correctly through the upper opening 320, remove the infant 301 from the device 300 as shown in FIG. 20C (step 16).
17. Optionally, feed the infant 301 dextrose solution, for example, throughout the procedure. For example, such feeding may be carried out through the upper opening 320.
18. At any time, if the infant 301 desaturates, remove the infant 301 from device 300.
19. Pull diaper down such that it is well below spinal tapping area 354.
20. To make sure the infant 301 is placed correctly, search for following landmarks.
21. Palpate the anterior iliac crests, an imaginary line connecting the two iliac crests crosses the L4 spinous process.
22. Palpate the spinous processes at the level of this line, carefully identifying midline. The spinal needle should be introduced at the L4-L5 interspace.
23. Perform the spinal tap procedure.
24. When procedure is finished, remove back strap 304 while ensuring the infant 301 is breathing.
25. Remove the head strap 302. The straps 302, 304 employed in the present invention 300 are preferably for single use only and must be disposed of after each procedure.
26. Lean the infant 301 away from the device.
27. Hover the infant 301 out of the device.

After use, the straps 302, 304 must be disposed as per healthcare institution policies. Any fluid is removed from the device 300 and the cradle portion is cleaned with disinfectant wipes per healthcare institution policy. The device 300 should be stored at room temperature. Multiple devices 300 should not be stacked on each other.

It would be appreciated by those skilled in the art that various changes and modifications can be made to the illustrated embodiments without departing from the spirit of the present invention. All such modifications and changes are intended to be covered by the appended claims.

What is claimed is:

1. An infant positioning device for stabilizing and maintaining an infant in a fixed position during a medical procedure, comprising:

a stand;

a chassis, having a length, attached to the stand and being configured and arranged to receive and position the infant in a desired position with back exposed, the chassis including at least one opening configured to aid the infant with breathing;

a pair of shoulder guards adjustably attached to opposing sides of the chassis; the shoulder guards being adjustably connected along the length of the chassis;

a post attached to each of the shoulder guards;

a first strap having opposing free ends; at least one hole residing through each of the free ends of the first strap; the opposing ends of the first strap being respectively connected to the shoulder guards via one of the at least one holes and respective posts to secure about the back of an infant;

ratchet grooves on opposing sides of the chassis corresponding to respective shoulder guards on opposing sides of the chassis;

a pair of caps respectively secured over the shoulder guards;

at least one post attached to each of the caps;

a second strap having opposing ends; at least one hole residing through each of the free ends of the second strap; the opposing free ends of the second strap being respectively connected to the at least one post attached to the caps via the at least one hole to secure about the head of the infant; and wherein the stand is connected to the chassis to stabilize and maintain the stand in an appropriate position throughout the duration of a medical procedure.

2. The infant positioning device of claim 1, further comprising:

a seat connected between the chassis and the stand.

3. The infant positioning device of claim 2, wherein the seat is curved.

4. The infant positioning device of claim 1, further comprising:

a floor member connected to the stand and located and configured to support the legs of the infant.

5. The infant positioning device of claim 1, wherein the shoulder guards include a detent that respectively releasably engages with the ratchet grooves on opposing sides of the chassis.

6. The infant positioning device of claim 1, wherein the stand is a tubular frame.

7. The infant positioning device of claim 1, further comprising:

cushioned feet attached to a bottom contact surface of the stand.

8. The infant positioning device of claim 7, wherein the cushioned feet are rubber.

9. The infant positioning device of claim 1, where the first strap and the second strap are made of biocompatible foam.

10. The infant positioning device of claim 1, wherein the chassis is concave.

11. The infant positioning device of claim 1, wherein the chassis is secured to the stand by fasteners.

12. The infant positioning device of claim 1, wherein the holes in the first strap are circular or oblong.

13. The infant positioning device of claim 1, wherein the holes in the second strap are circular or oblong.

14. The infant positioning device of claim 1, wherein the first strap defines an aperture in the substantial central portion thereof.

15. The infant positioning device of claim 1, wherein the second strap defines an aperture in the substantial central portion thereof.

16. The infant positioning device of claim 2, further comprising:

cushioned feet attached to a bottom contact surface of the seat.

17. The infant positioning device of claim 4, further comprising:

cushioned feet attached to a bottom contact surface of the floor member.

18. An infant positioning device for stabilizing and maintaining an infant in a fixed position during a medical procedure, comprising:

a stand;

a chassis, having a length, attached to the stand and being configured and arranged to receive and position the infant in a desired position with back exposed, the chassis including at least one opening configured to aid the infant with breathing;

a pair of shoulder guards adjustably attached to opposing sides of the chassis; the shoulder guards being adjustably connected along the length of the chassis;

a post attached to each of the shoulder guards;

a first strap having opposing free ends; at least one hole residing through each of the free ends of the first strap; the opposing ends of the first strap being respectively connected to the shoulder guards via one of the at least one holes and respective posts to secure about the back of an infant;

cushioned feet attached to a bottom contact surface of the stand; and wherein the stand is connected to the chassis to stabilize and maintain the stand in an appropriate position throughout the duration of a medical procedure.

19. An infant positioning device for stabilizing and maintaining an infant in a fixed position during a medical procedure, comprising:

a stand;

a chassis, having a length, attached to the stand and being configured and arranged to receive and position the infant in a desired position with back exposed, the chassis including at least one opening configured to aid the infant with breathing;

a pair of shoulder guards adjustably attached to opposing sides of the chassis; the shoulder guards being adjustably connected along the length of the chassis;

a post attached to each of the shoulder guards;

a first strap having opposing free ends; at least one hole residing through each of the free ends of the first strap; the opposing ends of the first strap being respectively connected to the shoulder guards via one of the at least one holes and respective posts to secure about the back of an infant;

cushioned feet attached to a bottom contact surface of the seat; and wherein the stand is connected to the chassis to stabilize and maintain the stand in an appropriate position throughout the duration of a medical procedure.

* * * * *